United States Patent [19]

Davies et al.

[11] 3,977,157

[45] Aug. 31, 1976

[54] PACKING MACHINES

[75] Inventors: Robert William Davies; Maxwell Francis Veness; Leonard Thornton; Leonard Henry Calver, all of London, England

[73] Assignee: Molins Limited, London, England

[22] Filed: Feb. 19, 1974

[21] Appl. No.: 443,938

[30] Foreign Application Priority Data

Feb. 16, 1973 United Kingdom ..... 7858/73

[52] U.S. Cl. ..... 53/207; 53/234; 53/388

[51] Int. Cl.[2] ..... B65B 11/32

[58] Field of Search ..... 53/148, 207, 230, 234, 53/236, 387, 388; 93/12 R, 12 C, 47, 51 HW, 54.2

[56] References Cited

UNITED STATES PATENTS

| | | | |
|---|---|---|---|
| 1,734,362 | 11/1929 | Brownell | 53/388 X |
| 2,603,047 | 7/1952 | Malhiot | 53/234 X |
| 3,125,007 | 3/1964 | Jaroff | 95/51 HW |
| 3,253,385 | 5/1966 | Beerman | 53/234 X |
| 3,728,841 | 4/1973 | Ullman | 53/387 X |
| 3,735,767 | 5/1973 | Kruse | 53/236 X |
| 3,762,130 | 10/1973 | Davies | 53/207 X |

*Primary Examiner*—Travis S. McGehee
*Assistant Examiner*—John Sipos
*Attorney, Agent, or Firm*—John C. Smith, Jr.

[57] ABSTRACT

A packing machine for cigarettes comprises a carton blank reservoir, a carton blank hopper, a blank feeding device, a blank transfer conveyor, a bundle drum, a packet forming drum, a packet stacking unit and a packet orientation unit.

Carton blanks are removed one at a time from the hopper by a suction device and fed intermittently by the transfer conveyor to a position adjacent a pocket in the packet forming drum, the blank then being pushed into the pocket so as to partially form it into a carton. Whilst on the transfer conveyor adhesive is applied to certain parts of the blank and initial holding of the blank takes place.

Foil wrapped bundles of cigarettes are pushed, two at a time, into pockets provided on the bundle drum and transferred one at a time into a partially formed carton contained in a pocket on the packet forming drum. Further folding and gumming of the partially formed carton takes place on the packet forming drum and the carton is completed on being pushed from the packet forming drum into the stacking unit, in which the adhesive is reheated and the packet passes between spring loaded walls to ensure it is of the required external dimensions. The completed packets are then fed into the orientation unit which presents each packet in the correct orientation for further operations to be carried out. In an alternative arrangement the transfer conveyor consists of cooperating endless bands and is driven continuously.

17 Claims, 40 Drawing Figures

Figure 1:
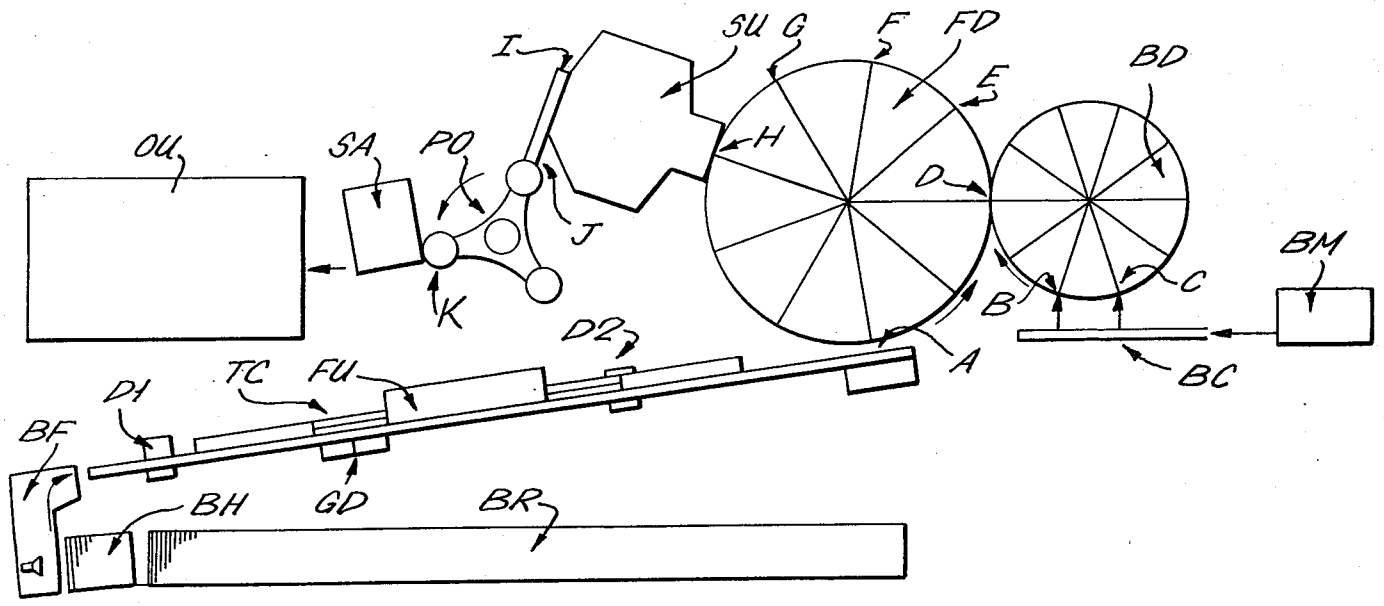

| | |
|---|---|
| FIG. 6A. | FIG. 6C. |
| FIG. 6B. | FIG. 6D. |

264
258
262
263
253
XIII
BD
205
198
261
260
259
D
250
248
221
FD
249
205
215
255
225
218
205
219
229
222
XII
212
221
170
P01
166
P02
175
M
188
189
169
167
172
168
174
171
182
183
101
181
186
176
173
184
185
188
177
180
190
187
193
178
179
192
XIII 258
255
257
263
264
260
261
201
198
253
252
254
202
259
200
203
204
199
251
244
194
197
195
236
196
250
247
248
243
245
249
241
201
237
239
198
207
233
202
206
230
212
231
208
228
232
221
229
213
228
220
222
205
161
210
246
175
166
169
189
P01
167
BC
191
188
171
162
179
180
173
172
178
193
190
192
164
165
163

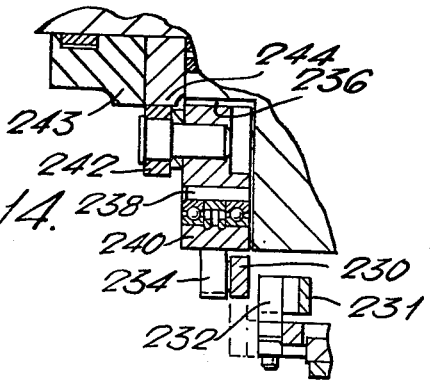
FIG. 14.
FIG. 16.
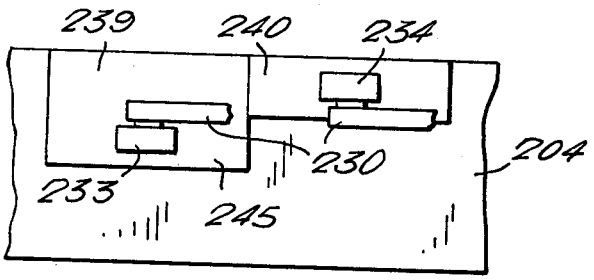
FIG. 17.
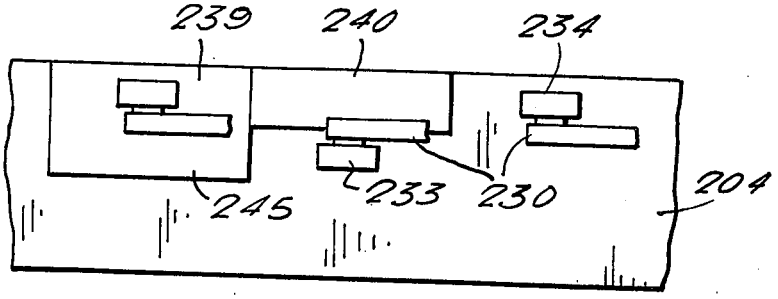

PACKING MACHINES

This invention concerns improvements in or relating to packing machines, and in particular to machines which are suitable for packing cigarettes.

When packing cigarettes certain operations are carried out, namely, a bundle of cigarettes is first formed, the bundle is then wrapped in foil, and a packet blank is folded and stuck around the wrapped bundle to form a packet containing the bundle.

The present invention is concerned with machines which will fold a packet blank around a wrapped bundle, stick the blank to form the cigarette packet, the bundle having previously been formed and wrapped on another machine or machines. However, the invention is not limited to machines for the packing of bundles of cigarettes, but could be embodied in machines for packing other articles.

According to the present invention there is provided apparatus for packing an article in a packet including a rotatable member having a plurality of pockets, supply means to feed packet blanks in succession to a position adjacent said rotatable member, inserting means for moving each successive blank into one of said pockets whilst the said pocket is stationary at an insertion position; said inserting means being arranged to perform folding operations on said blank to start its formation into a packet as it is moved into the pocket, means for intermittently rotating said rotatable member so that each pocket in succession is brought to rest at said insertion position and thereafter moved in steps from said insertion position to an ejection position; loading means positioned adjacent said rotatable member between said insertion and ejection positions for delivering an article into the partially formed packet at a loading position, means for performing further folding operations on the partially formed packet between said loading position and said ejection position; and ejector means at said ejection position for pushing said partially formed packet out of said pocket into means for completing the formation of the packet.

With most forms of packet it is required to secure various overlapped parts together by adhesive and in a machine as defined above we may also provide devices for applying adhesive to appropriate areas of the blank and/or of the partially formed packet; one or more such devices may for example be located adjacent to the rotatable member, between the loading position and the ejection position, so that adhesive application is effected at suitable stages in the folding operations.

According to another aspect of the invention we provide apparatus for packing an article in a packet including endless conveyor means provided with a plurality of regularly spaced article receiving pockets, a rotatable member having a plurality of regularly spaced blank receiving pockets, supply means to feed packet blanks in succession to a first insertion position adjacent said rotatable member, first inserting means for moving each successive blank into one of said blank receiving pockets whilst said pocket is stationary at said first insertion position, said inserting means being arranged to perform folding operations on said blank to start its formation into a packet as it is moved into the pocket, first drive means for intermittently rotating said rotatable member so that each blank receiving pocket in succession is brought to rest at said first insertion position and thereafter moved in steps from said first insertion position to a loading position and thence to an ejection position, means for feeding articles in succession to a second insertion portion adjacent said conveyor means, second inserting means for moving articles simultaneously into two adjacent article receiving pockets of the conveyor means, second drive means for intermittently advancing said conveyor means so that each article receiving pocket in succession is brought to rest at said loading position, loading means at said loading position for transferring articles from successive article receiving pockets into the partially formed packets in successive blank receiving pockets at said loading position, means for performing further folding operations on each partially formed packet between said loading position and said ejection position, and ejector means at said ejection position for pushing said partially formed packet out of each blank receiving pocket into means for completing the formation of the packet, wherein said loading means is operated twice for every operation of said second inserting means.

According to a further aspect of the invention we provide apparatus for packing an article in a packet including a reservoir and a hopper for packet blanks, means for feeding said packet blanks along a first path through said reservoir to said hopper, means for removing said blanks in succession from said hopper, means for feeding said blanks along a second path, means for performing operations on said blank, to start its formation into a packet, whilst the latter is being fed along said second path, collating means for completed packets, means for moving said completed packets along a third path through said collating means, means for performing further operations on said blank whilst the latter is being fed from said second path towards and along said third path, said first, second and third paths being in vertical alignment, and means for substantially reversing the direction of movement of said blank during transfer from said first path to said second path and from said second path to said third path.

According to a further aspect of the invention we also provide an apparatus for conveying articles successively from a loading station to an unloading station, comprising an endless conveyor provided with a plurality of regularly-spaced article-receiving pockets, in which each of said pockets has movable side walls and a movable bottom member including means for causing said side walls to move apart to facilitate the entry of an article into the pocket at the loading station, ejector means for moving the bottom member through the pocket to eject an article therefrom at the unloading station, and means operable with the ejector means for displacing the side walls in the same direction as the bottom member during an initial part of the operation of the ejector means so that the side walls are positioned to guide the article during a latter part of the movement of the bottom member.

In such conveying apparatus the conveyor member is preferably in the form of a rotatable drum. Such apparatus may with particular advantage be used when each ejected article is required to be placed in a receiving pocket forming part of a further conveyor member as the displacement of the side walls may be arranged to bring them into engagement with the receiving pocket so as to guide the ejected article into said receiving pocket. As will be later described by way of example, such conveying apparatus may be embodied in a packing machine as defined above to serve as the loading means for delivering an article into each partially formed packet.

According to a yet further aspect of the invention, we provide apparatus for folding flaps projecting from opposite parallel edges of one face of a packet, comprising a tubular member having an internal passage of such cross-section to permit the packet to pass through it with said one face leading while engagement of said flaps with walls of said passage causes said flaps to be folded against side faces of the packet, in which a pusher member is provided to urge said packet through said passage and a counter-member is arranged to be moved through said passage in synchronism with the movement of said pusher member and in advance of said pusher member by a distance equal to the thickness of the packet (measured perpendicular to said one face), said countermember having a surface facing said pusher member for engagement with said one face of the packet to oppose distortion thereof during folding of said flaps.

According to a still further aspect of the invention, there is also provided apparatus for folding a packet blank, comprising a cyclically-movable support for conveying blanks one at a time past stationary folder members so that successive edge portions of the blank protruding from the support are folded by engagement with successive ones of the stationary members, in which said support comprises a platform having at least two relatively-movable portions, drive means being provided for moving each of said portions in timed relation to the movement of the other portion or portions so that initially both or all portions of the support are aligned to receive a flat blank and move said blank past a first stationary folder member disposed to engage and fold an edge portion of the blank projecting from one portion of the platform, whereafter said one portion of the platform stops while motion of at least one other portion of the platform continues past another stationary folder means disposed to engage and fold another edge portion of the blank projecting from said other portion of the platform. Such apparatus may be employed in the inserting means of a packing machine as defined above.

Figure 2:
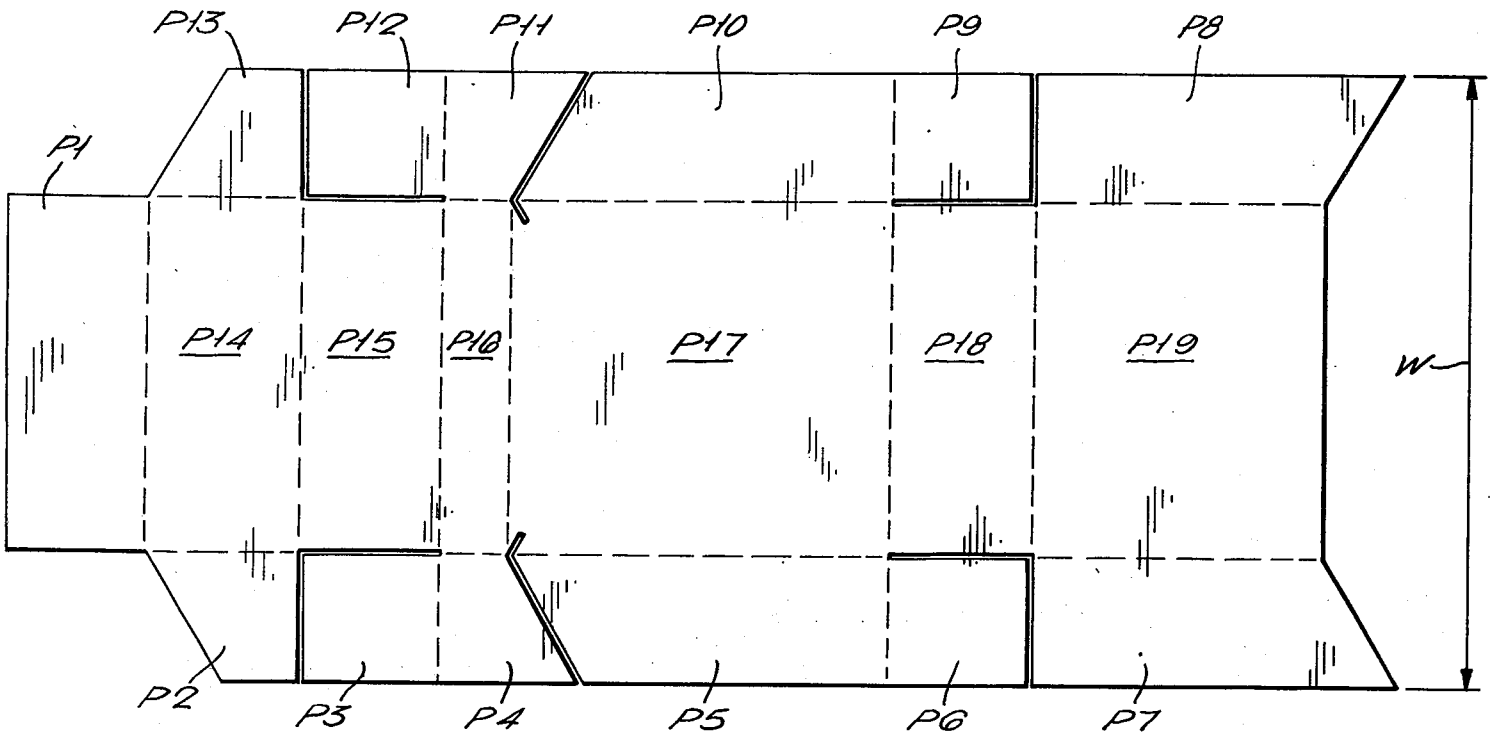
Figure 3:
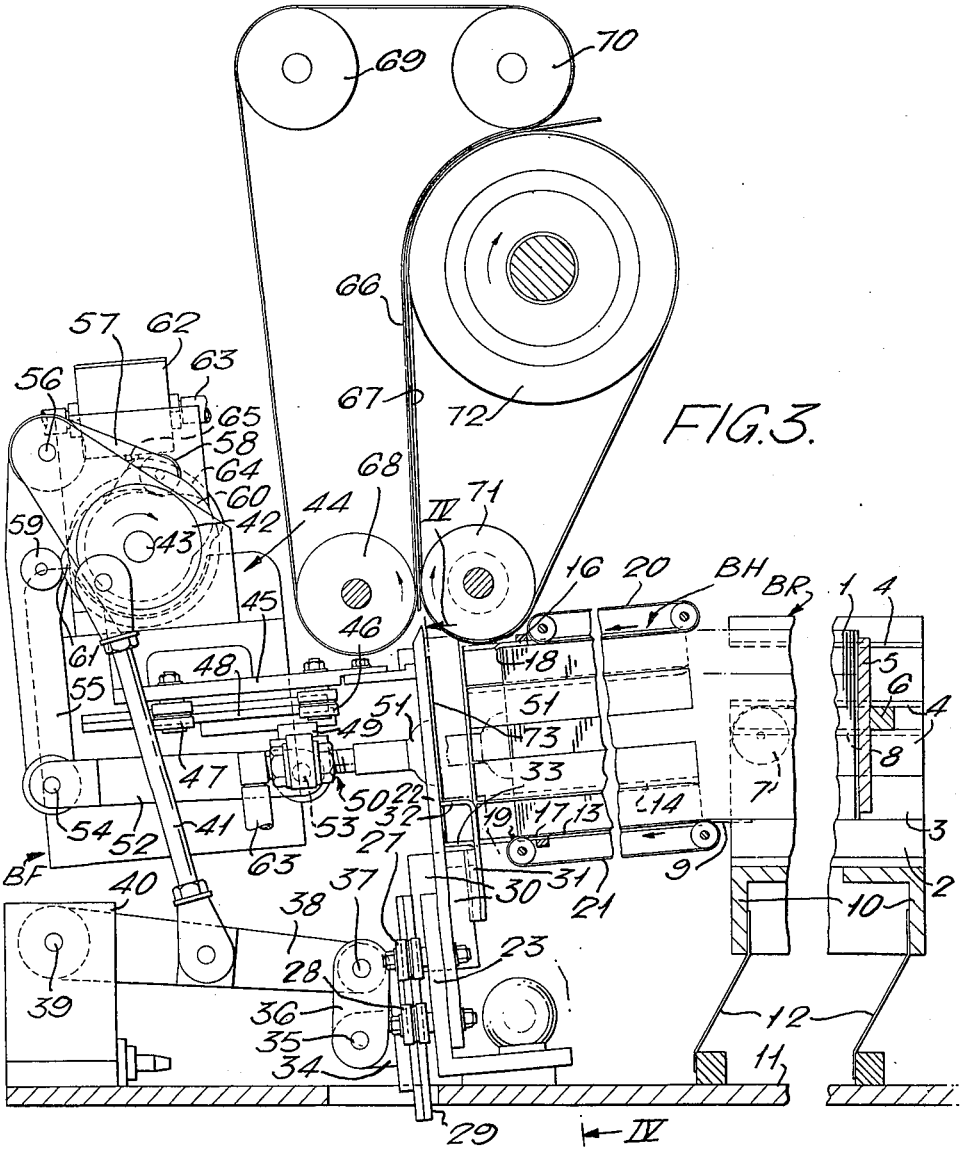
Figure 4:
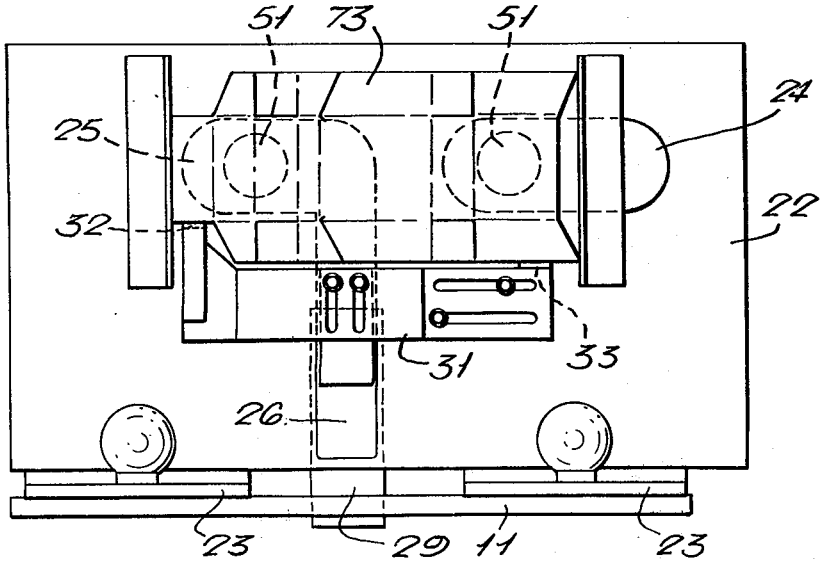
Figures 5, 6A:
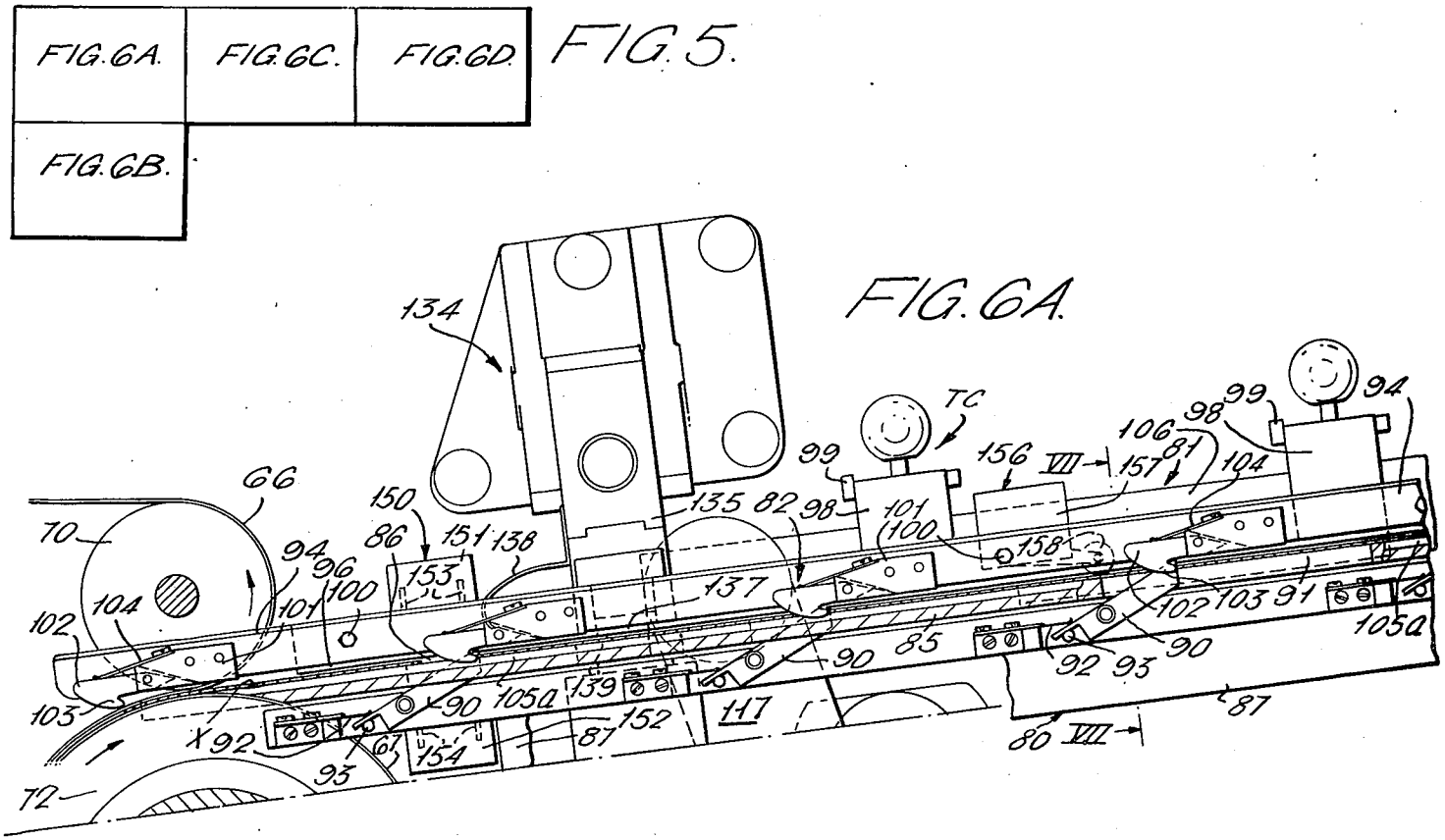
Figure 6B:
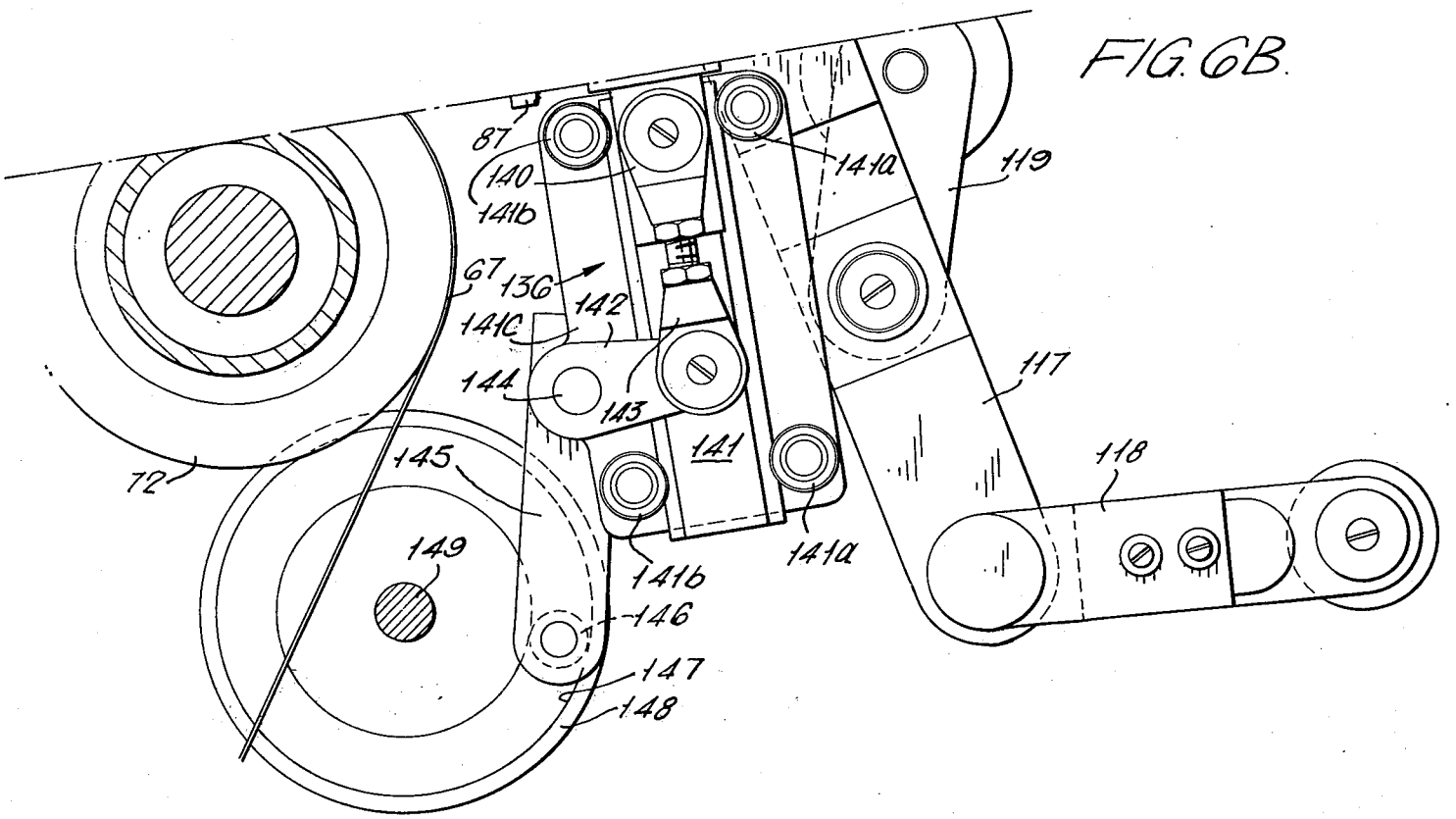
Figure 6C:
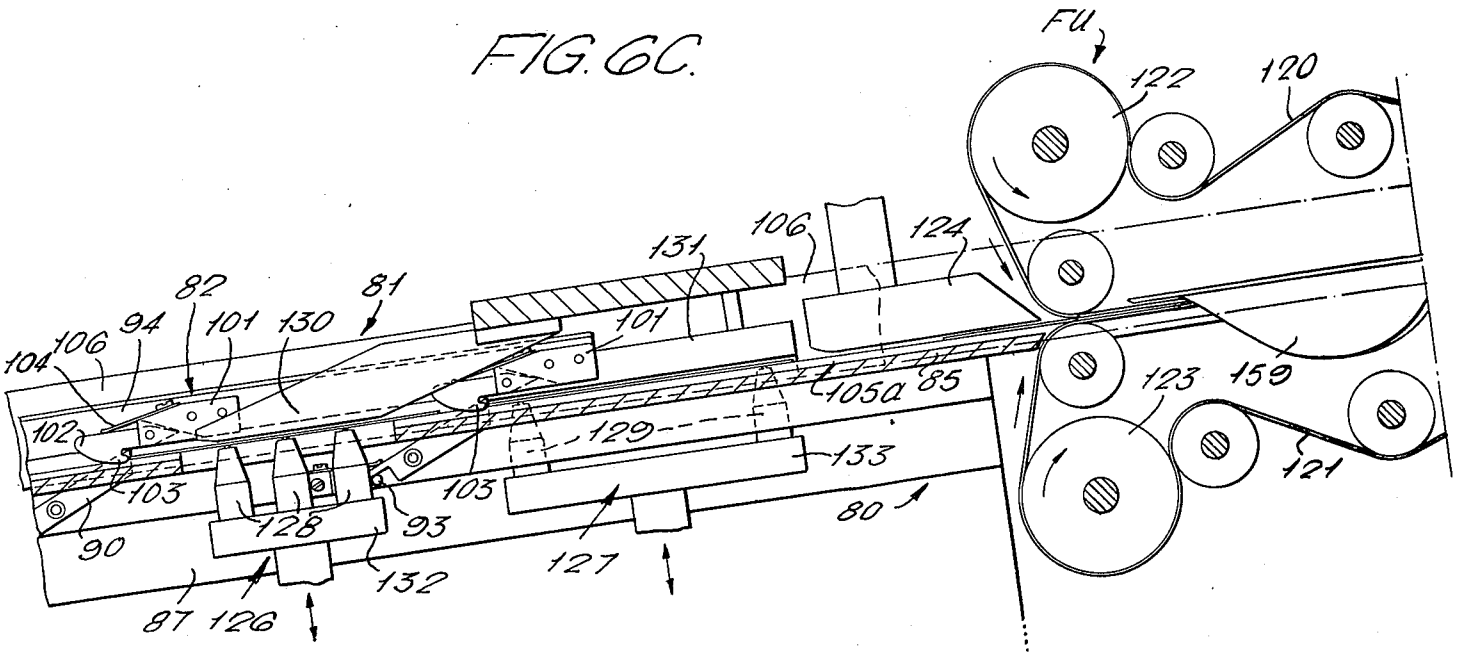
Figure 6D:
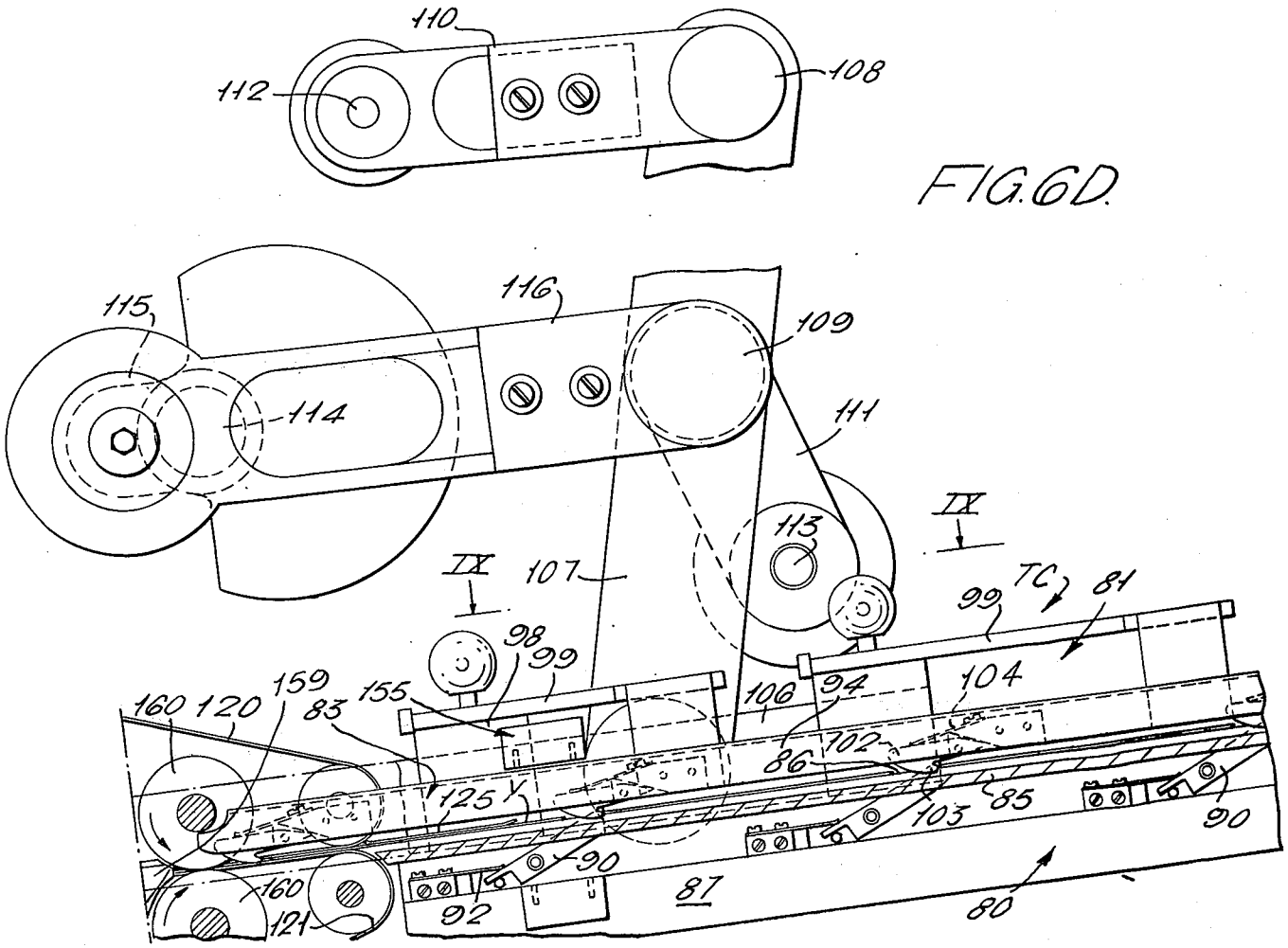
Figure 7:
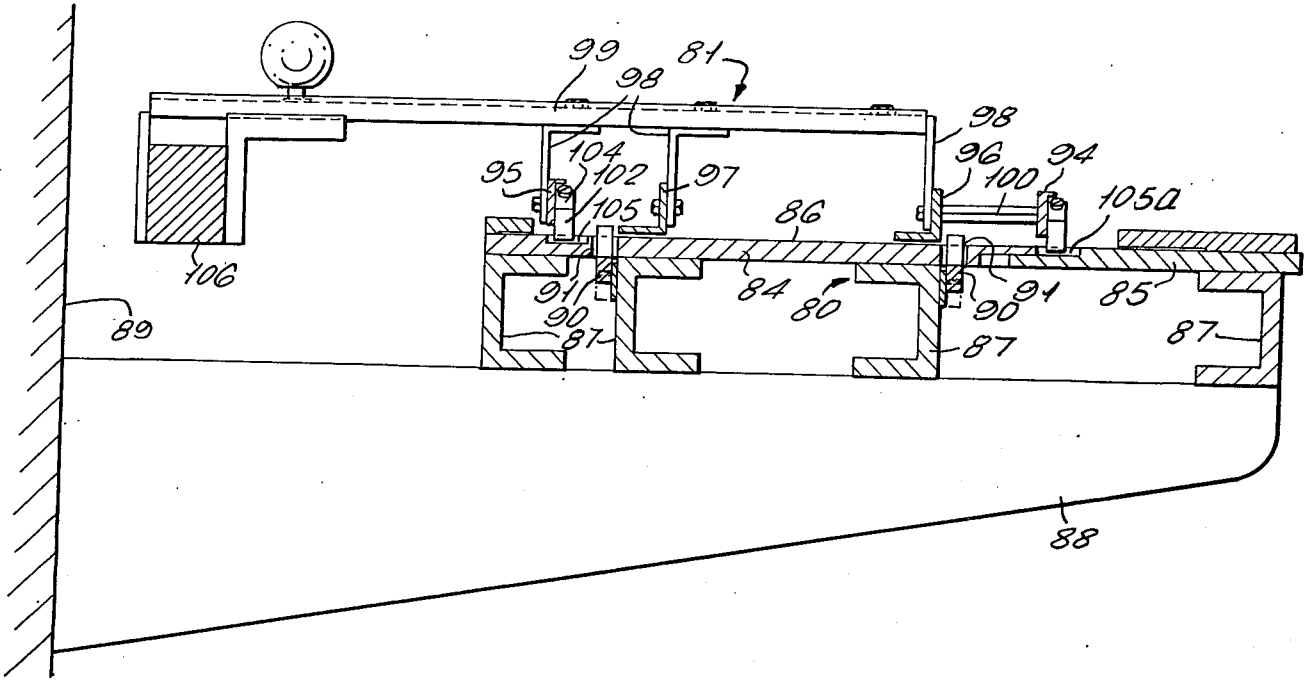
Figure 8A:
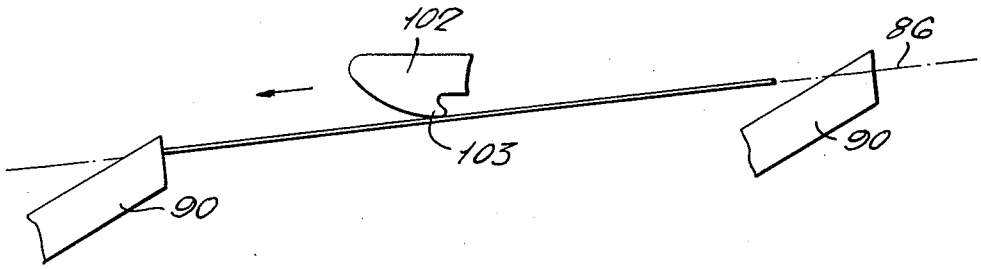
Figure 8B:
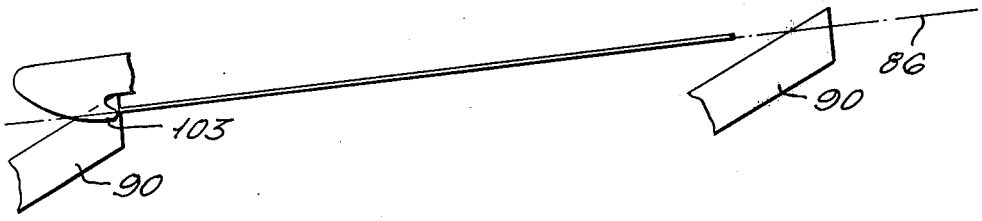
Figure 8C:
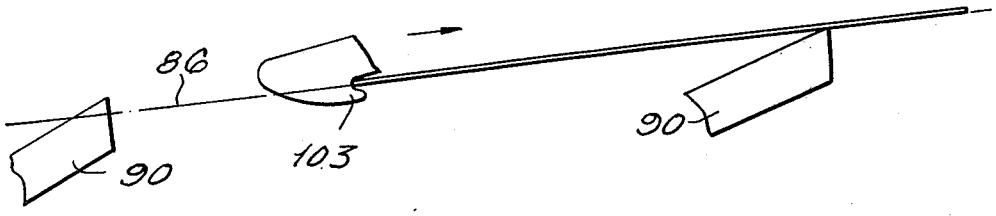
Figure 9:
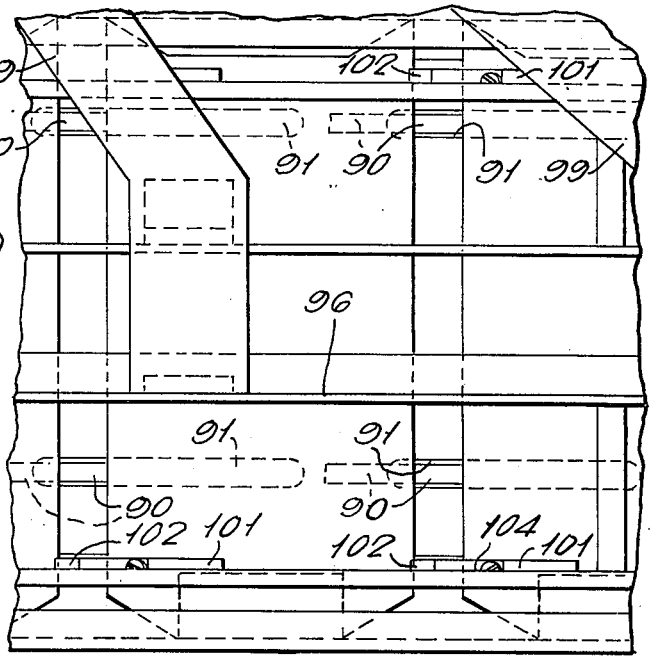
Figure 10:
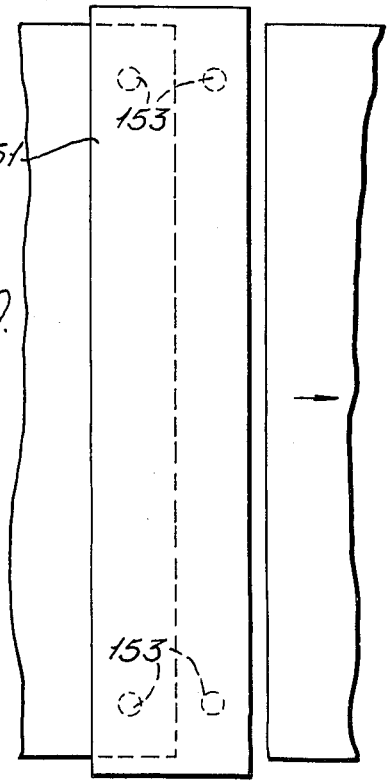
Figure 11:
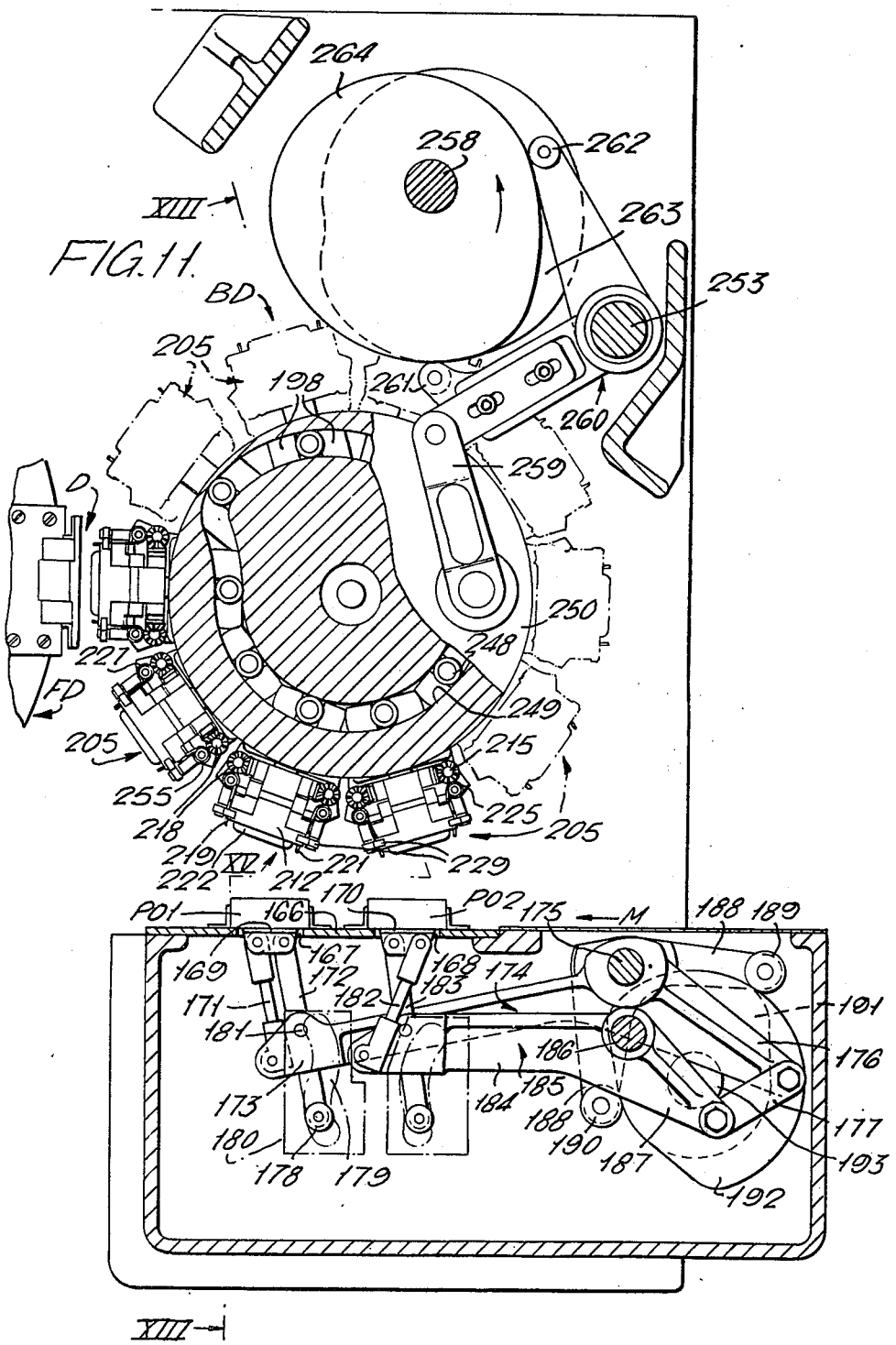
Figure 12:
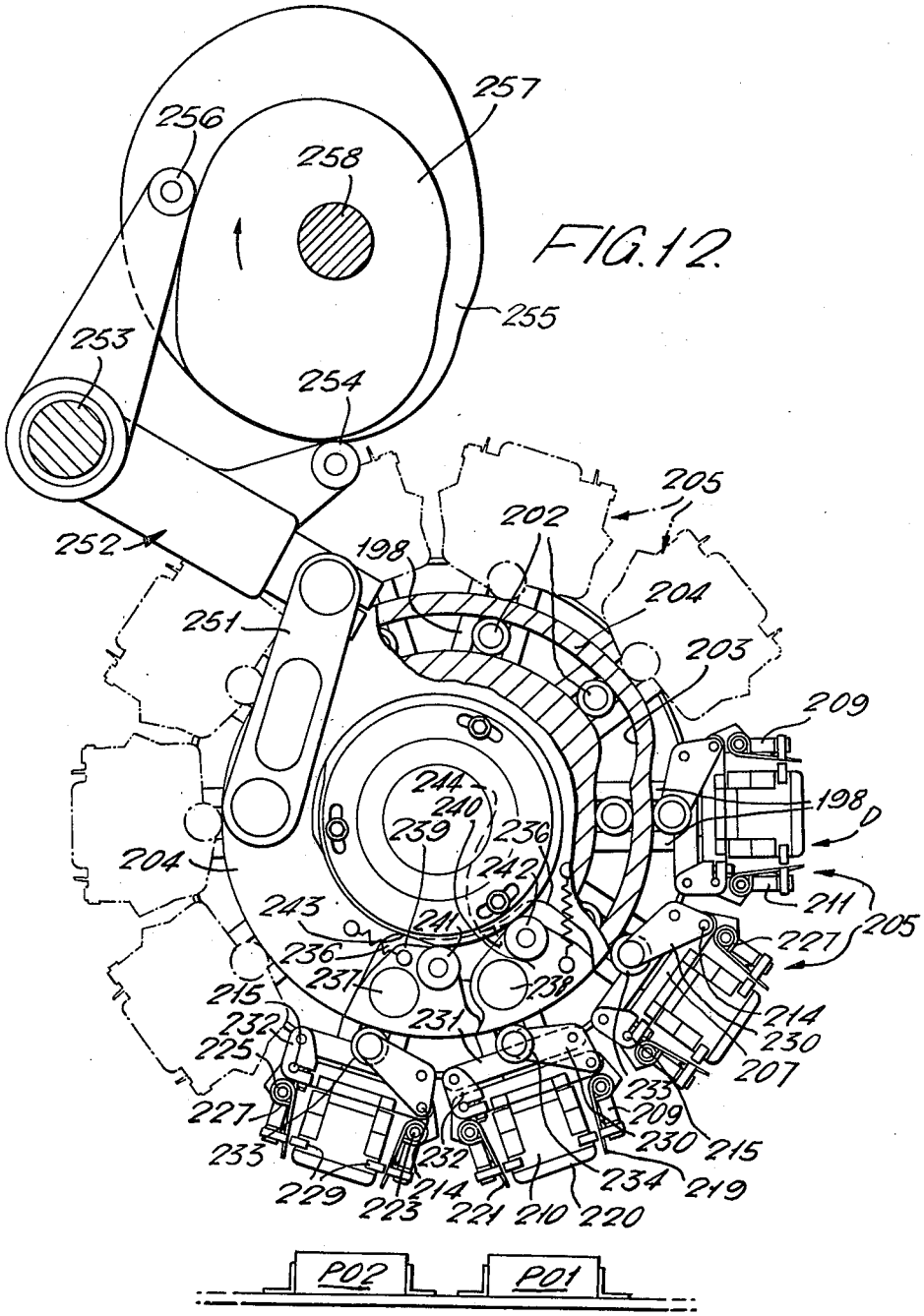
Figure 13:
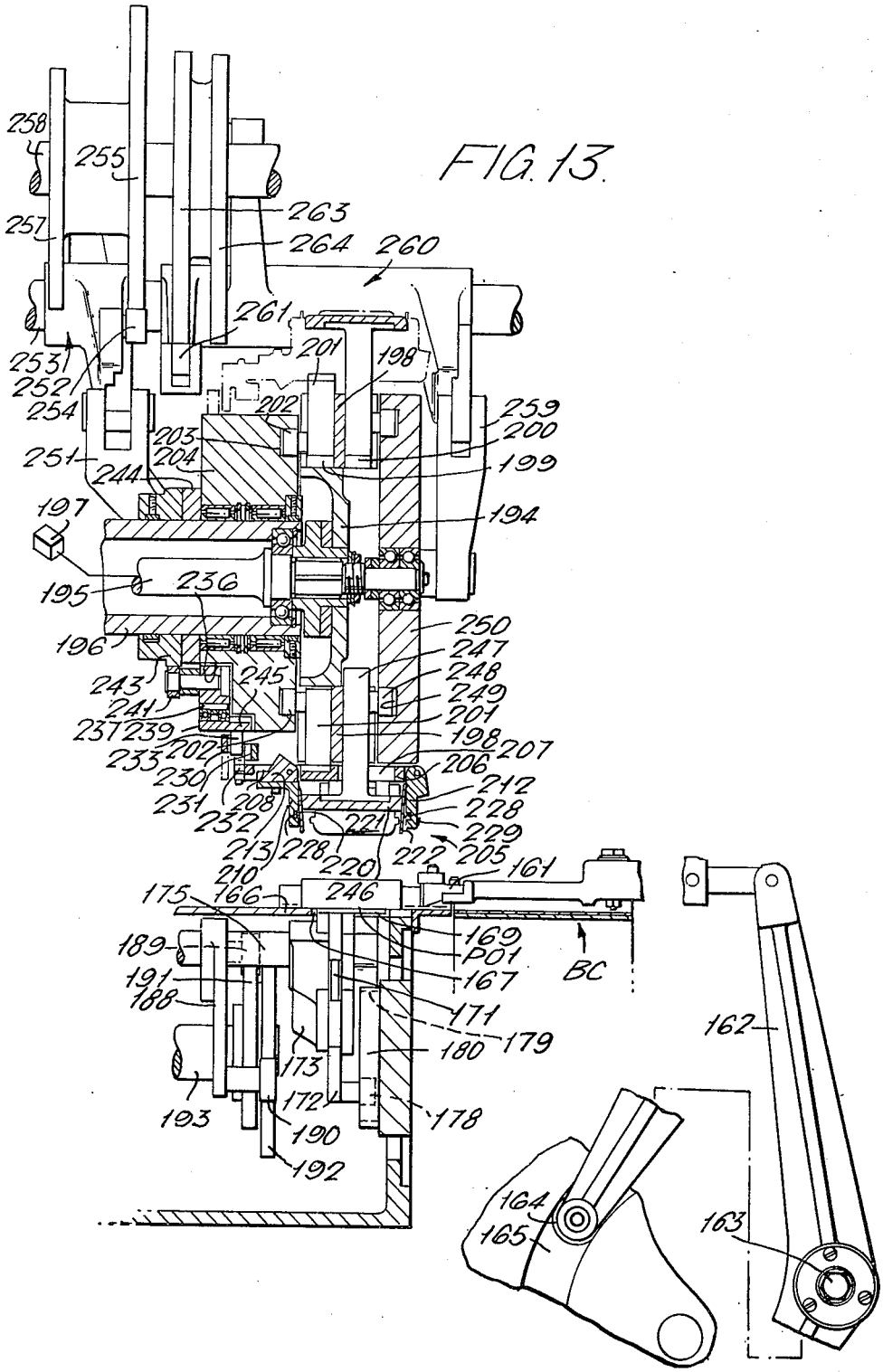
Figure 15:
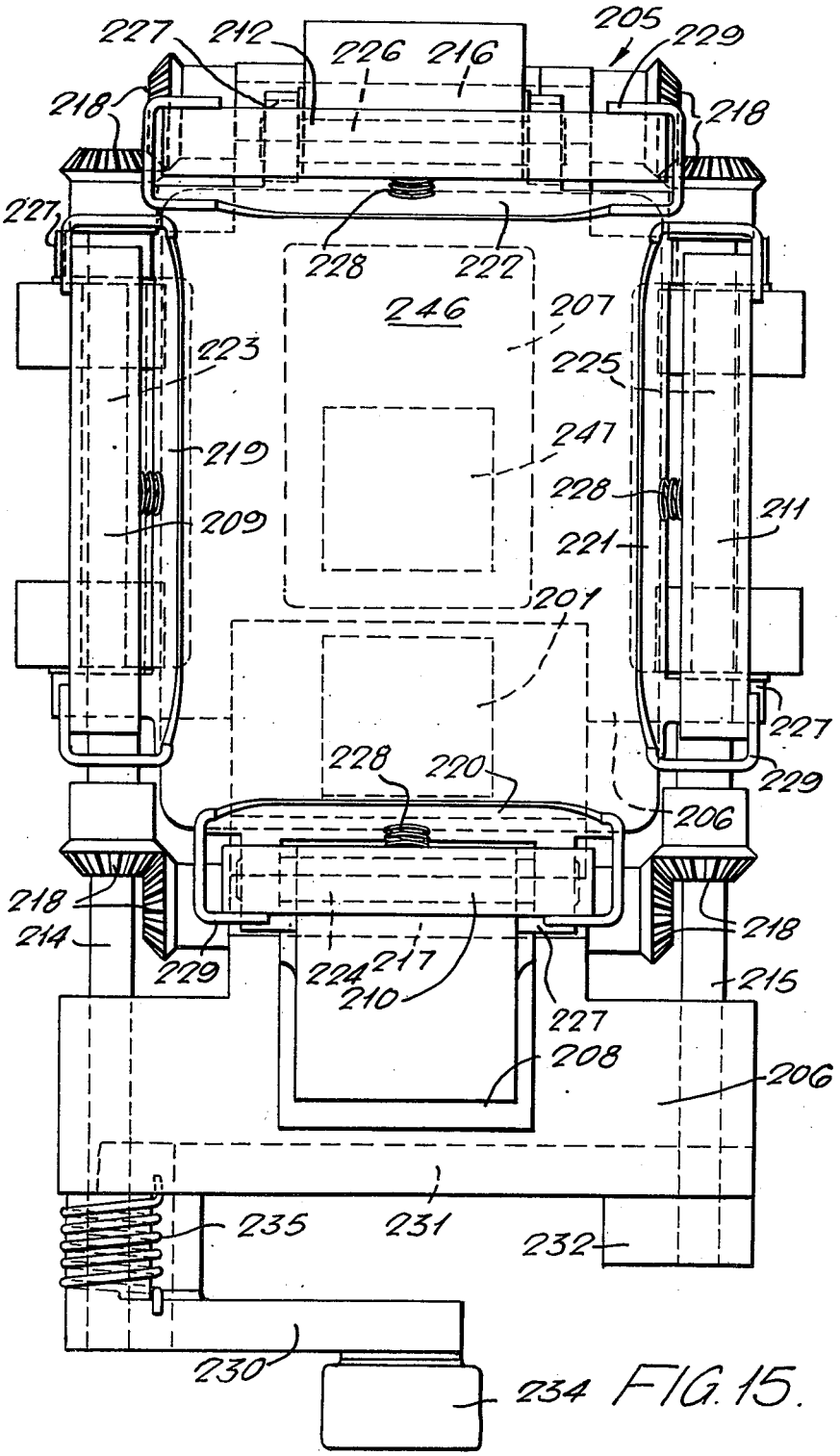
Figure 18:
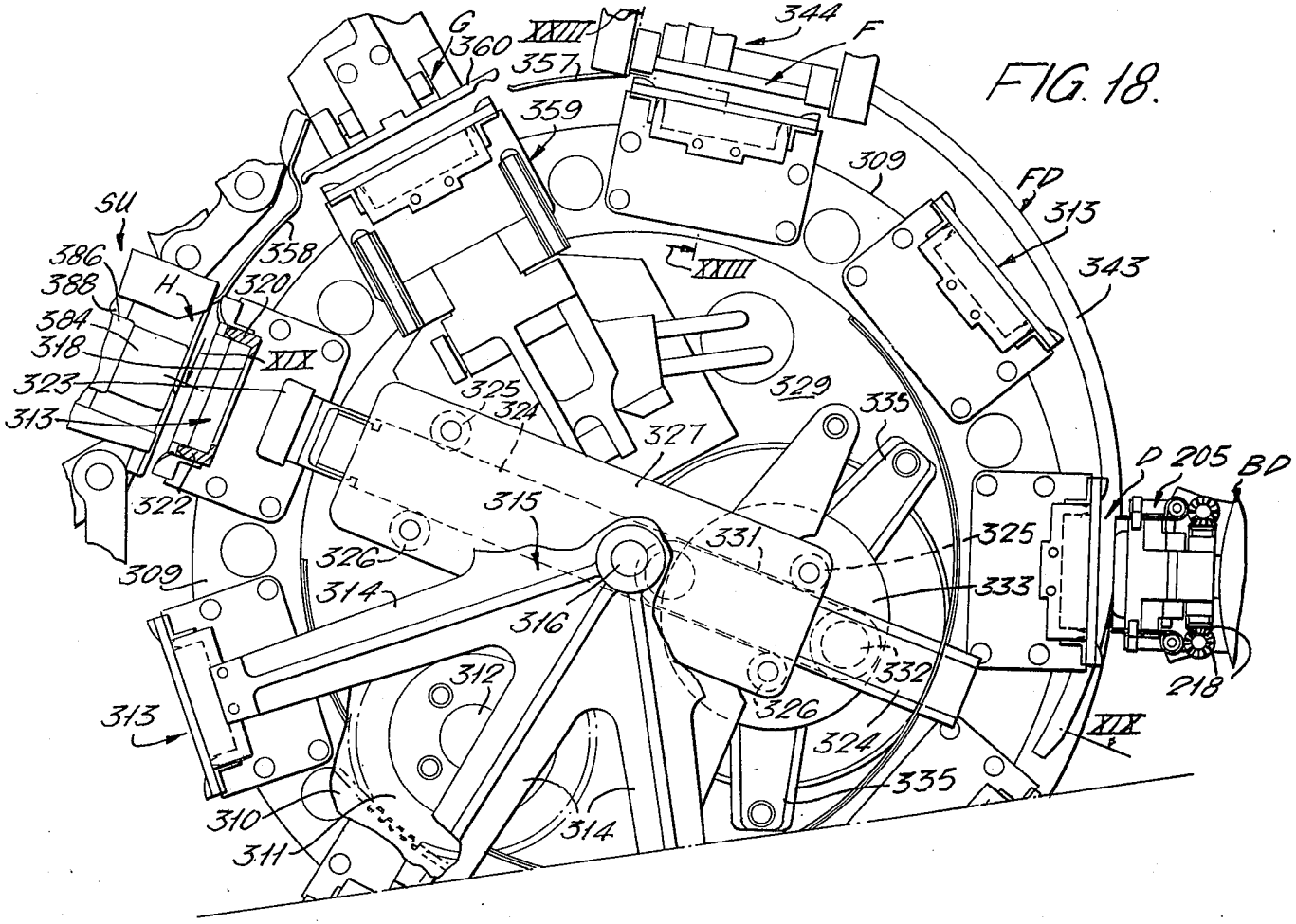
Figure 18A:
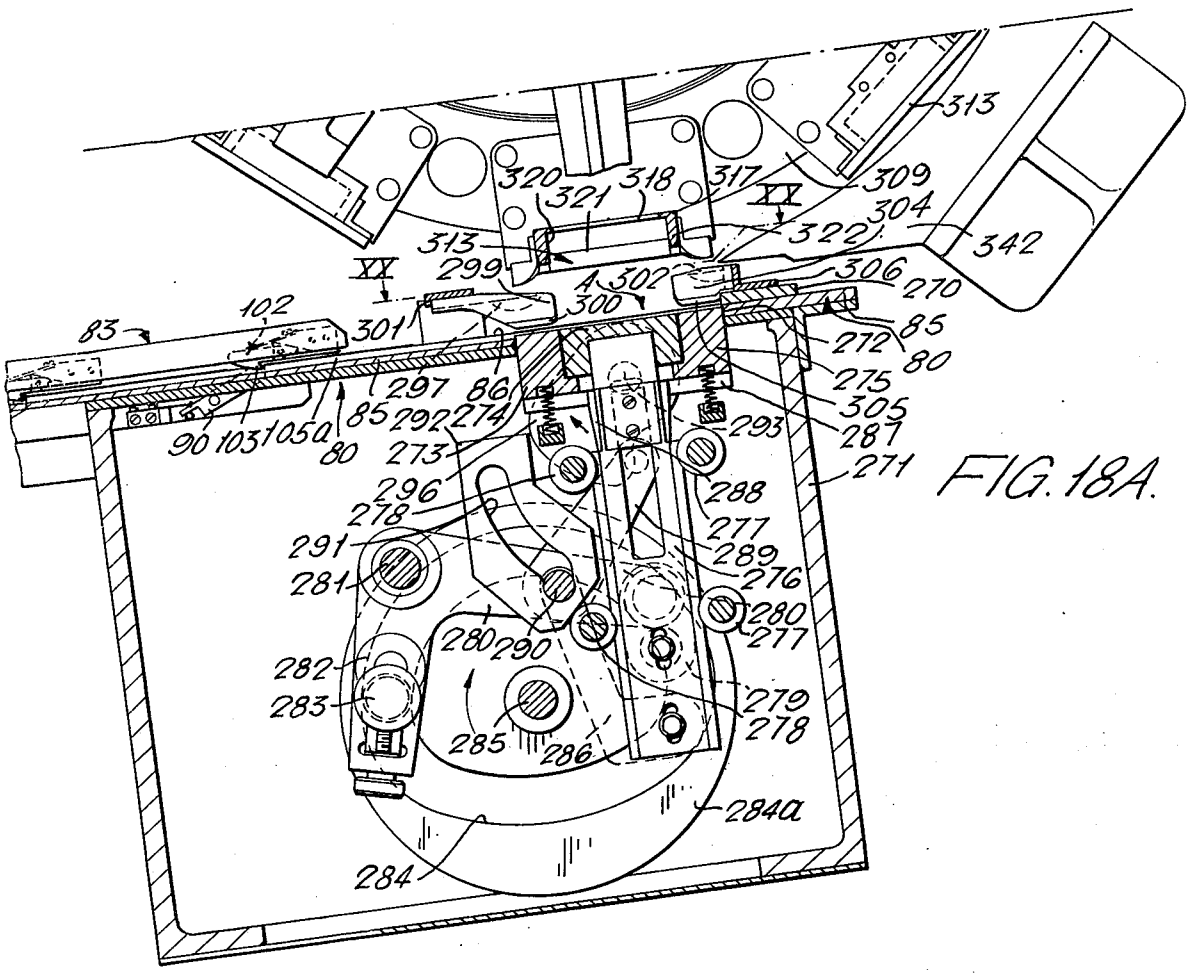
Figure 19:
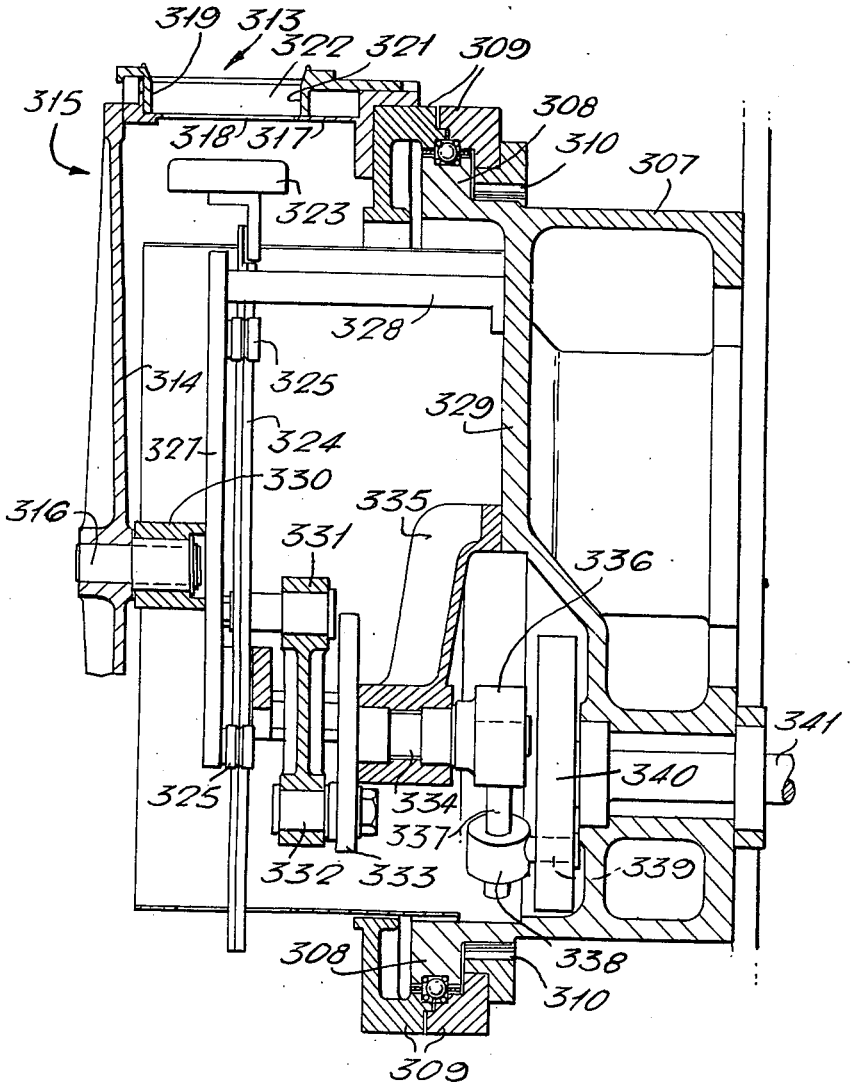
Figure 20:
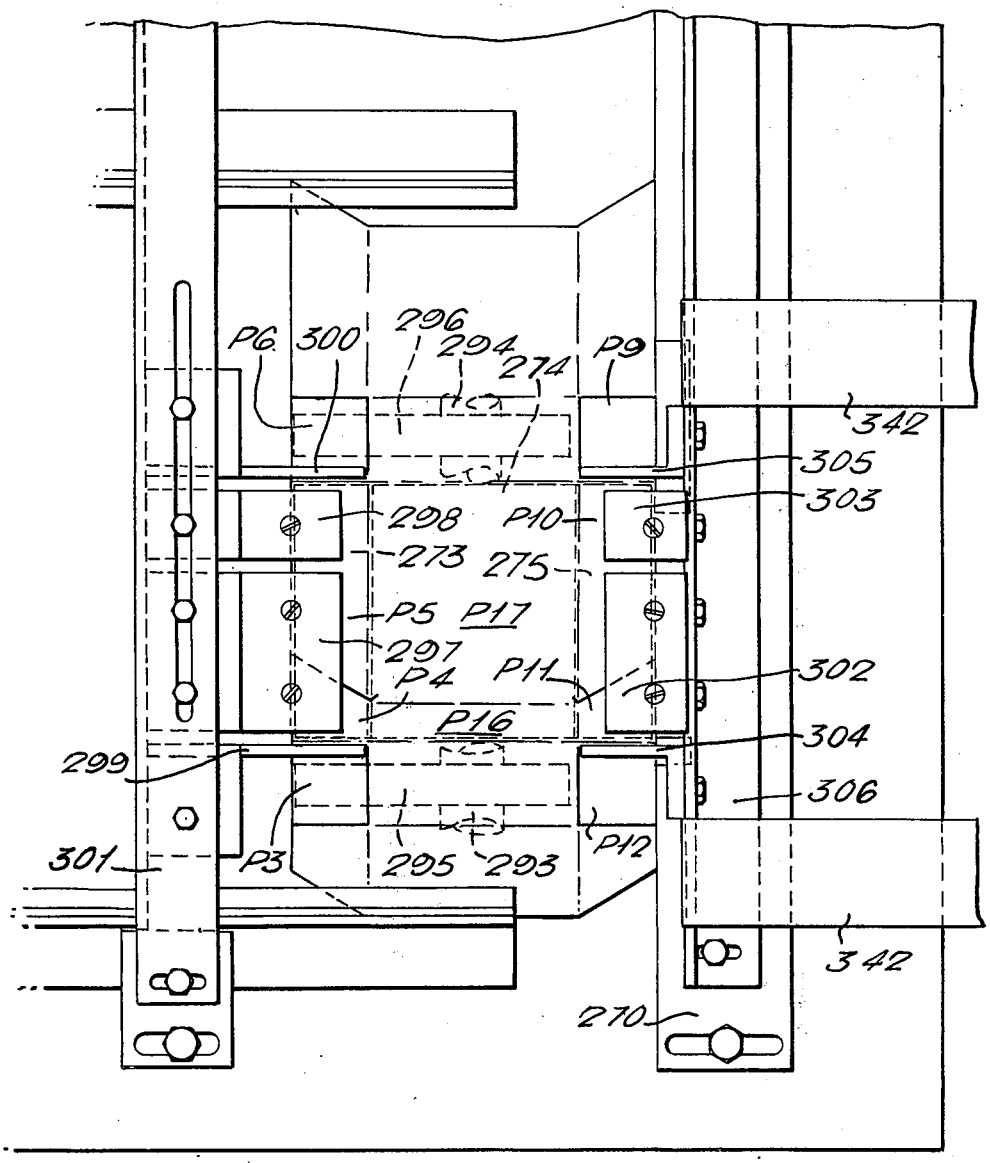
Figures 21, 22:
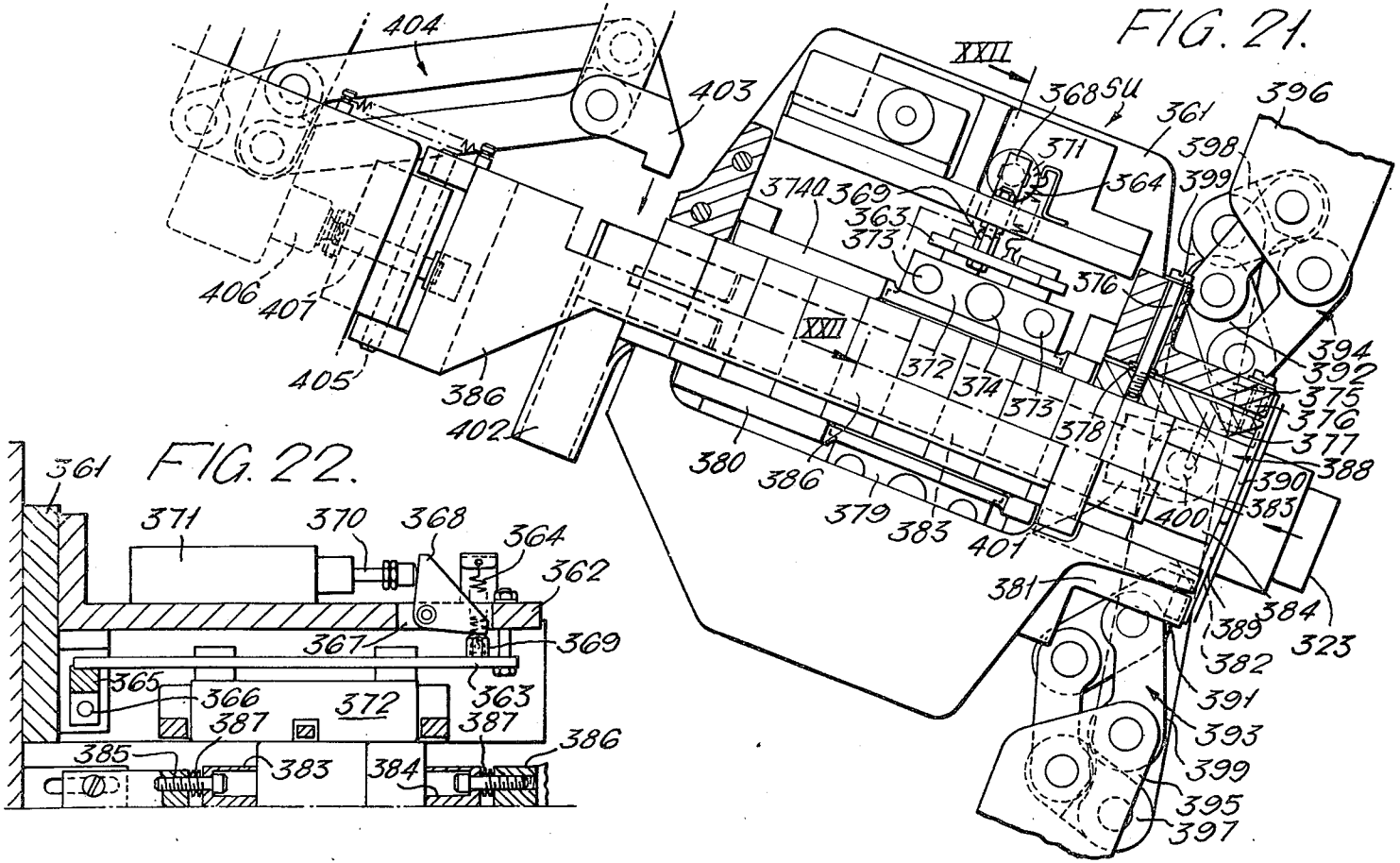
Figure 23:
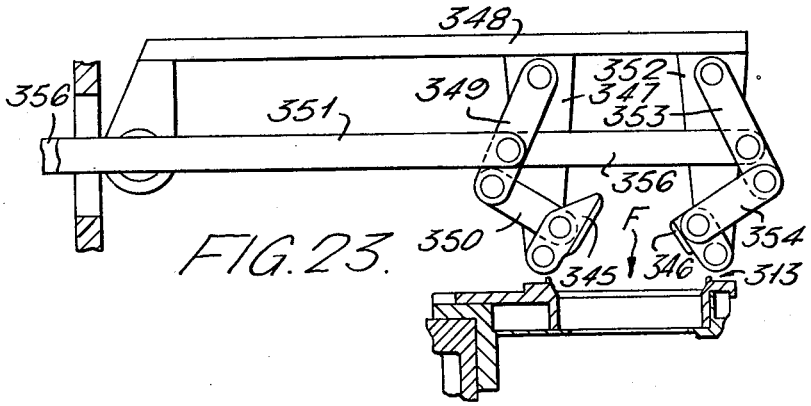
Figure 29:
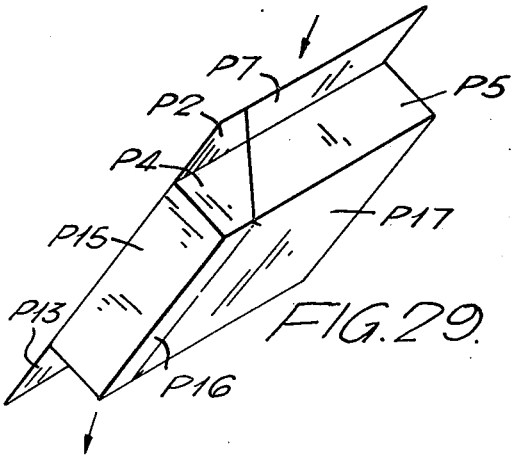
Figure 30:
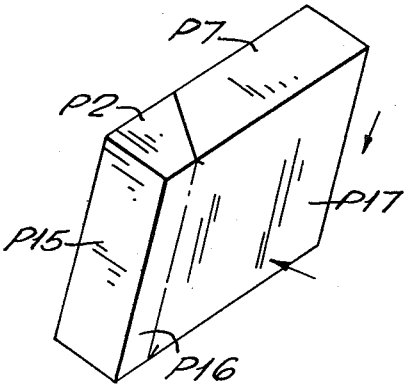
Figure 31:
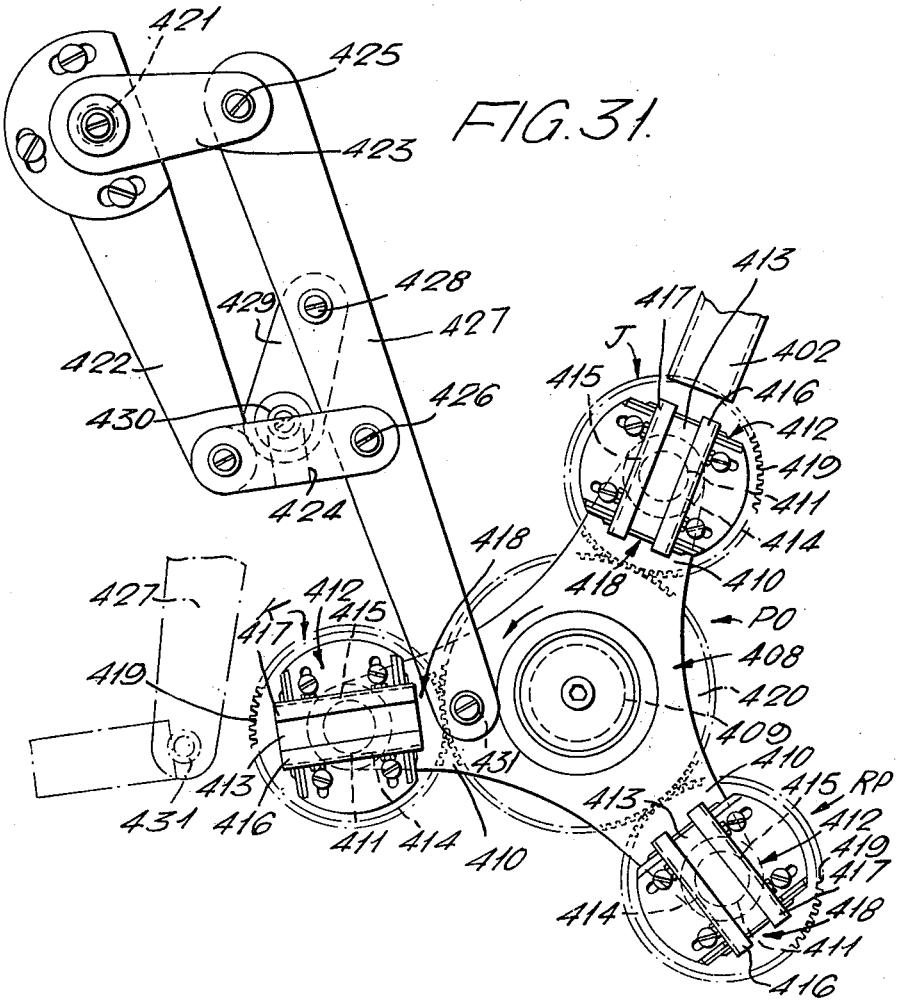
Figure 32A:
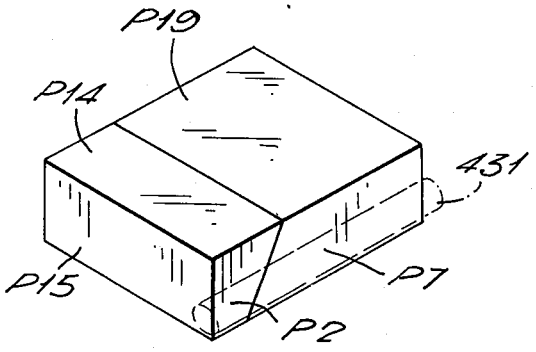
Figure 32B:
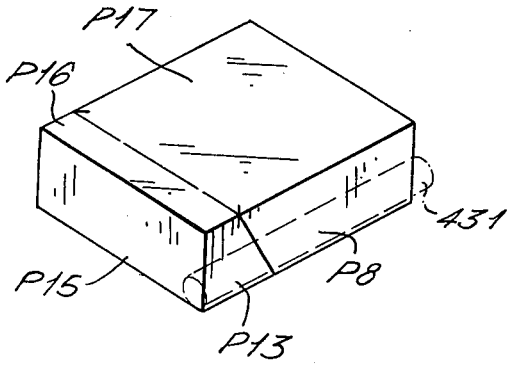
Figure 33:
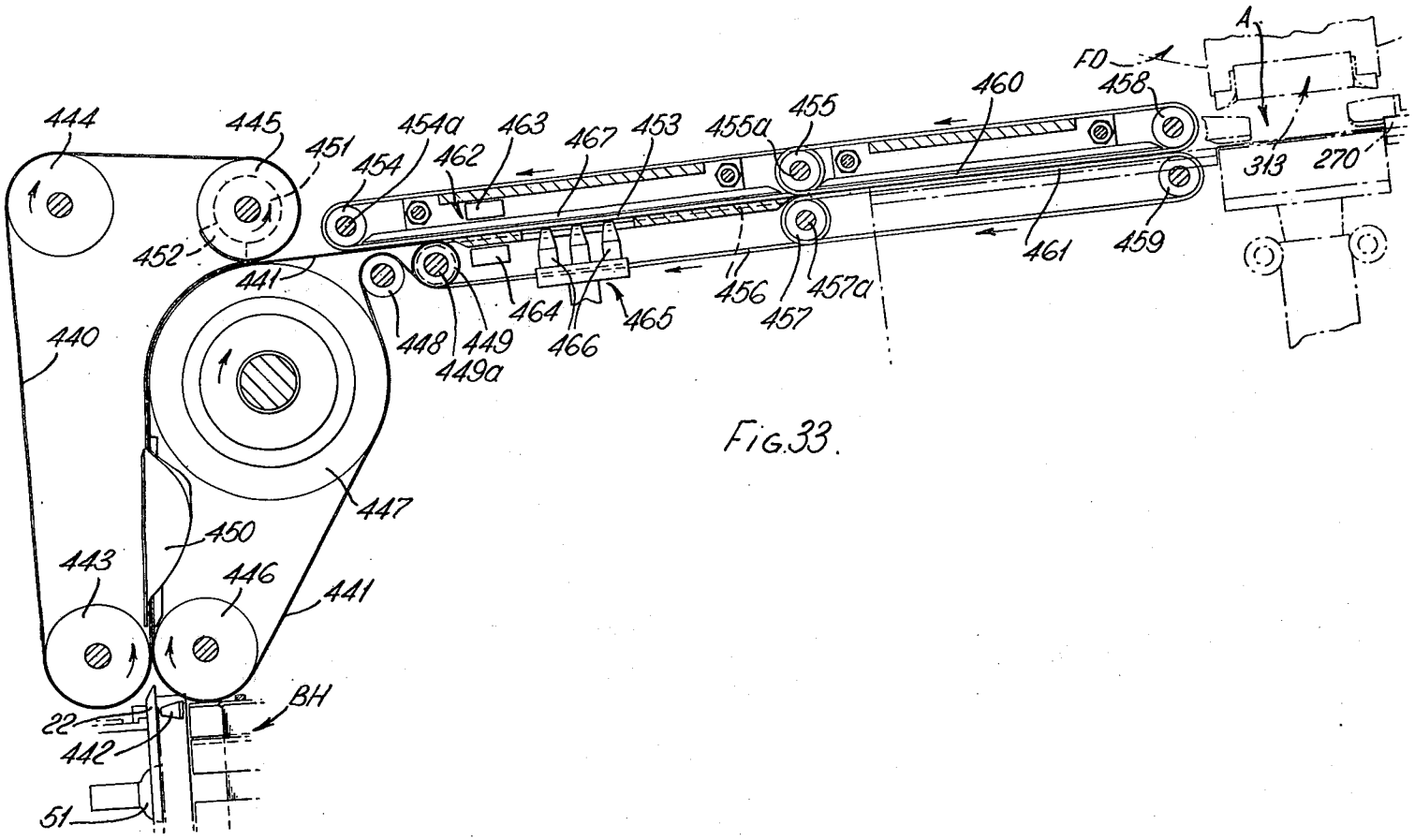

A preferred embodiment of the invention will now be described, by way of example only, with reference to the accompanying drawings in which:

FIG. 1 is a diagrammatic representation of a cigarette packing machine embodying the invention, FIG. 2 illustrates one form of packet blank for use on the machine of FIG. 1, prior to being folded, FIG. 3 is a front view, partly in section, of a blank feeding device, FIG. 4 is a section on the line IV—IV of FIG. 3, FIG. 5 is a diagram of how FIGS. 6A, 6B, 6C and 6D together form a single view, FIGS. 6A, 6B, 6C and 6D together show a front view, partly in section, of a conveyor for conveying blanks past devices which carry out various operations on the blanks, FIG. 7 is a section on the line VII—VII of FIG. 5, FIGS. 8A, 8B, 8C are diagrams showing how blanks are moved by the conveyor shown in FIGS. 5 and 6, FIG. 9 is a plan view of part of the apparatus of FIG. 6, viewed as indicated by the line IX—IX of that Figure, FIG. 10 is a diagrammatic plan view of detector devices associated with the conveyor of FIGS. 5 and 6, FIG. 11 is a front view, partly in section, of apparatus for feeding wrapped bundles of cigarettes and inserting them one at a time into a partly formed packet, FIG. 12 is a rear view, partly in section, of part of the apparatus of FIG. 11, and drawn in a larger scale, FIG. 13 is a section on the line XIII—XIII of FIG. 11, FIG. 14 is a part section on the line XIV—XIV of FIG. 11 and drawn to a larger scale, FIG. 15 is a view of part of the apparatus of FIG. 11 looking in the direction of arrow XV in that Figure and drawn to a larger scale, FIGS. 16 and 17 are diagrams, illustrating parts shown in FIG. 12, in different positions during operation of the apparatus of FIGS. 11 to 15, FIGS. 18 and 18A together shown a front view, partly in section, of apparatus for forming a blank into a cigarette packet and inserting a bundle of cigarettes into the packet during the forming operation, FIG. 19 is a section on the line XIX—XIX of FIG. 18, FIG. 20 is a plan view of part of the apparatus of FIG. 18, viewed as indicated by the line XX—XX of that Figure and drawn to a larger scale, FIG. 21 is a front view, partly in section, of apparatus for ensuring that the completed packets are of the desired dimensions, FIG. 22 is a section on the line XXII—XXII of FIG. 21, FIG. 23 is a section on the line XXIII—XXIII of FIG. 18, FIGS. 24 to 30 show progressive stages in the forming of a blank into a cigarette packet by the apparatus of FIG. 18, FIG. 31 is a front view of apparatus for conveying, and changing the orientation of, completed packets of cigarettes, FIGS. 32A and 32B show two different ways in which a packet may be orientated after being ejected from the apparatus shown in FIG. 31, FIG. 33 is a front view of an alternative form of conveyor to that shown in FIGS. 6A–6D.

GENERAL DESCRIPTION

The machine to be described requires a supply of wrapped bundles of cigarettes and, in FIG. 1, reference BM indicates any convenient apparatus for grouping cigarettes into suitable bundles, (e.g. each comprising three rows of cigarettes), and wrapping them in metal foil. The apparatus BM forms no part of the present invention and will not be further described.

The wrapped bundles are then fed, by a conveyor BC to the input of the packing machine embodying the present invention.

This machine comprises basically the following units; a blank reservoir BR, a blank hopper BH, a blank feeding device BF, a blank transfer conveyor TC, a bundle drum BD, a packet forming drum FD, a stacking unit SU, and a packet orientation unit PO.

Blanks are removed one at a time from the hopper BH by the device BF and fed on the conveyor TC, as shown by the arrow. The blanks are fed intermittently to the right (as viewed in FIG. 1) by the conveyor TC until they reach and stop at a position A adjacent the drum FD. At spaced locations along the conveyor TC detectors D1, D2 are provided, as will be described later with reference to FIG. 5, for detecting whether a blank is missing, or misaligned with respect to the conveyor TC. Between the detectors D1 and D2, a device, shown in FIG. 5, is provided to print identification marks on the blanks and, downstream of the detector D1, a gumming device GD is provided by which portions of the blank have adhesive applied to them. Between the device GD and the detector D2 is a unit FU which folds one of the portions of the blank to which adhesive has been applied into contact with another portion thereof so as to become adhesively secured thereto. Whilst passing through the unit FU the blanks are moved continuously.

The drum BD is adapted to receive wrapped bundles from the conveyor BC two at a time, at positions B and C, and to rotate intermittently in a clockwise direction in steps of 36°, the arrangement being such that two bundles of cigarettes are transferred from the conveyor BC to the drum BD after every second movement of the drum BD. Each time the drum BD comes to rest a single wrapped bundle will be at position D, in the drum BD, facing the drum FD.

The blank at position A is transferred from the conveyor TC into one of 9 pockets in the periphery of the drum FD which is driven intermittently, in an anti-clockwise direction, in synchronism with conveyor TC and drum BD, in steps of 40°. During its transfer into one of the pockets on the drum FD the blank is folded so that a packet is partially formed in the pocket on drum FD. After transfer of the blank to the drum FD the latter is rotated anticlockwise, and each time it comes to rest a partially formed packet in a pocket on drum FD will be at position D, facing a wrapped bundle in drum BD, and the bundle is then pushed from the drum BD into the partially formed packet on drum FD.

The drum FD then continues to rotate in 40° steps in an anti-clockwise direction and while it is moving between, and is stationary at, positions E, F and G, further folding and adhesive applying operations are performed on the packets each of which now contains a wrapped bundle of cigarettes. After a further 40° step from position G each packet in turn is brought to rest at position H adjacent the stacking unit SU and, whilst the drum FD is stationary, is ejected from the drum FD into the unit SU. As this ejection takes place, final folding operations are performed on the packet, which completes the formation of the packet round the wrapped bundle of cigarettes. As each completed packet is pushed into the unit SU it abuts the packet which was ejected from the preceding pocket of the drum FD. In this way a stack of abutting packets is formed in the unit SU, the arrangement being such that as a packet is pushed into the unit SU at position H, a packet is pushed out of the unit SU at position I. Whilst in the unit SU the packets pass between heaters, and spring loaded plates ensure that when each packet emerges at position I it is of the correct dimensions.

From position I each packet is moved past position J into one of three holders carried on the unit PO, which is rotated intermittently in an anti-clockwise direction in 120° steps to carry each packet in turn to position K where the packet is pushed out of the unit PO and fed to further apparatus SA for applying a stamp to the packet and thence to apparatus OU for overwrapping the packet in transparent material. The apparatuses SA and OU form no part of the present invention and will not be described further. The unit PO may also be used, as will be described later, as a means for ejecting faulty packets.

BLANK RESERVOIR AND FEED

The various units of the machine will now be described in detail with reference to the rest of the drawings, the units being described in the order in which a packet blank and a bundle of cigarettes are handled as they pass through the machine.

Referring first to FIGS. 2, 3 and 4, the blank reservoir BR supports a horizontal stack 1 of blanks, the blanks resting on one edge, so that the panel P1 (FIG. 2) is nearest the viewer when looking at FIG. 3. The stack 1 rests on bottom rails 2 and 3, the top edges of which respectively engage the lower edges (as viewed in FIG. 3) of the blank formed by panels P2-P7, and the panel P1. Side rails 4 are also provided to help guide the blanks in the reservoir BR. In FIG. 3, only the side rails 4 for guiding the right hand edge (as viewed in FIG. 2) of the blanks can be seen, but it will be understood that suitable side rails are also provided to guide the left hand edge. Extending across the reservoir BR, between the guide rails for the two edges, is a back plate 5 to which is fixed a block 6, the latter extending beyond the side rails on both sides of the reservoir. Fixed to the side rails, one on each side of the reservoir, are two drums 7 (only one such drum being visible in FIG. 3) each of which contains a spirally wound flat spring 8, which is self-biased towards the fully wound position, and one end of which is fixed to the centre of the drum, the other end being fixed to one end of the block 6. The arrangement is such that as the plate 5 is moved to the right (as viewed in FIG. 3) by the machine operator, the springs 8 are unwound from the drums 7. The operator places a pile of blanks in the reservoir between the blanks already contained therein and the plate 5 which is then released and will be urged to move to the left (as viewed in FIG. 3) by the springs 8, across a fixed plate 9 and into the blank hopper BH. The rails 2 of the reservoir BR are carried on a number of cross-pieces 10, which are attached to blocks fixed to a base plate 11, by flat springs 12. This arrangement allows the reservoir to be vibrated, by any convenient form of mechanism (not shown), to assist in the feeding of the blanks towards the blank hopper BH, as is necessary because the stack 1 may be several feet in length.

The blank hopper BH comprises bottom plates 13, 14 which engage the same edges of the blanks as the rails 2, 3, and side guides 15 which are similar to the rails 4. In addition a number of top plates 16 and bottom plates 17 are provided (only one of each being visible in the drawings), each of which is curved (at 18 and 19 respectively) to provide lips past which the blanks need to be pulled, as will be described later. Also the hopper BH is provided with top and bottom feed belts 20, 21 respectively, which are driven intermittently in the direction shown by the arrows, to feed the blanks towards the lips 18, 19, and thus to the blank feeding devices BF. It will be noted from FIG. 3 that the hopper BH slopes downwardly towards the feeding device BF, which will now be described.

Spaced a short distance to the left (as viewed in FIG. 3) of the hopper BH is a plate 22 which is carried on the base plate 11 by brackets 23. The plate 22 extends upwardly from the brackets 23 to a position slightly above the level of the top plates 16 of the hopper BH, and is provided with two horizontally elongated apertures 24, 25 (FIG. 4), the latter having a vertical extension 26. Rotatably mounted on one of the brackets 23 are two pairs of rollers 27, 28 (only one roller of each pair being visible in FIG. 3), the rollers of each pair being spaced apart so that a slide 29 may be moved up and down between them. The slide 29 has a block 30 fixed to it which extends through the aperture 26 and carries a lifting plate 31 provided with two lugs 32, 33 which engage each blank in turn as will be described later.

Fixed to the opposite face of the slide 29 to that which block 30 is fixed, is a bracket 34 which is pivotally connected at 35 to one end of a short link 36. The other end of the link 36 is pivotally connected at 37 to one end of an arm 38, which at its other end is pivotally carried at 39 on a block 40. A connecting rod 41 is pivotally connected at one end, to a position approximately halfway along the length of arm 38, and at the other end to a crank disc 42, the latter being fixed to a shaft 43. The shaft 43 is journalled in a frame, generally indicated in FIG. 3 by the reference 44, which is carried on a fixed part of the machine (not shown).

Carried on the frame 44 is a plate 45 on which two pairs of rollers 46, 47 are rotatably mounted, the rollers being arranged in a similar way to the rollers 27, 28 so that a slide 48 may be reciprocated horizontally. The slide 48 carries a beam 49 which in turn, carries a unit 50, the latter having a pair of rubber suction pads 51 attached to it. A link 52 is pivotally connected at one end 53 to the unit 50 and, at the other end 54, to one arm 55 of a bell crank lever pivoted at 56. The other arm 57 of the bell crank lever carries a cam follower 58, and a further cam follower 59 is mounted on the arm 55. The cam followers 58, 59 respectively engage cams 60, 61, which are fixed to the shaft 43.

Mounted above the shaft 43 is a spool valve 62 one side of which is connected to a suction pump (not shown) and the other side of which is connected, via pipe 63, to the interior of the suction pads 51. The arrangement is such that suction is applied intermittently to the pads 51, and this is achieved by means of a further cam 64, fixed to the shaft 43, which engages a rod 65 which causes the valve spool to move to alternately connect and disconnect the interior of the pipe 63 to the suction pump.

Mounted a short distance above the plate 22 and extending upwardly therefrom are two endless belts 66, 67 which extend respectively round rollers 68, 69, 70 and 71, 72.

In operation the shaft 43 is driven continuously, in the direction shown by the arrow, and the cams 60, 61 cause the slide 48, the unit 50 and the suction pads 51 to move to the right (as viewed in FIG. 3) from the full line position to the chain dot position in contact with the leading blank of the stack 1. At the same time cam 64 moves rod 65 so that suction is applied to the pipe 63 and thus the interior of pads 51. Continued movement of the cams 60, 61 cause the pads 51 to grip and pull the leading blank of the stack 1 past the curved portions 18, 19 of the plates 16, 17 respectively and carry it to the left until it engages the plate 22, at which time cam 64 allows rod 65 to move in the opposite direction and suction is cut off from the pads 51 to release the blank therefrom in the position shown at 73 in FIGS. 3 and 4. As the blank is being carried by the pads 51 towards the plate 22, rotation of the crank disc 42 causes the connecting rod 41 to lift slide 29, and thus the plate 31 and lugs 32, 33. The arrangement is such that just as the blank engages the plate 22 and suction is cut off from the pads 51, the lugs 32, 33 engage the bottom edge of the blank and push it upwardly until it is gripped between the belts 66, 67 which are driven continuously, in the direction of the arrow in FIG. 3, and carry the blank to a position such that it can be engaged by the transfer conveyor TC. Continuous rotation of the shaft 43 will thus cause successive leading blanks to be removed from the stack 1 and fed to the conveyor TC. The blanks are arranged in the stack 1 so that the pads 51 engage the face which will be the outside face of the completed packet. In FIG. 2 it will be assumed that the face of the blank shown is that which will form the inside of the completed packet.

BLANK TRANSFER CONVEYOR

The blank transfer conveyor TC will now be described, in detail, with reference to FIGS. 5 to 10.

The conveyor TC comprises a fixed frame 80, which extends from the rollers 70, 72 to a position adjacent the drum FD at a position A (FIG. 1), and a movable frame 81, mounted for movement to and fro, above, and substantially parallel to, the frame 80.

The frame 80 consists of a number of pairs of plates 84, 85 (FIG. 7), arranged to abut end to end, so as to form a continuous surface 86 extending along the whole length of the frame 80. The plates 84, 85 are supported on four carriers 87, which are spaced apart across the width of the frame 80 (as shown in FIG. 7), and extend, apart from that portion over which the unit FU is located, over substantially the whole length of the abutted plates 84, 85. The carriers 87 are, in turn, supported on a number of cross members 88 which are attached to a fixed plate 89 (FIG. 7) of the machine, the frame 80 thus being cantilevered out from the fixed plate 89.

The two inner carriers 87 each have a number of pawls 90 pivotally mounted on them at equally spaced positions along their length. The pawls 90 are each arranged so that one end extends through one of a number of slots 91, provided in the plates 84, so as to project above the surface 86; the pawls being resiliently held in this position by means of leaf springs 92. The distance by which the pawls extend above the surface 86 is limited by stops 93 against which projections, provided on the pawls, are held by the springs 92, as shown in FIGS. 6A, 6C and 6D. The pawls on each of the inner carriers 87 are spaced apart by a distance somewhat greater than the width of a blank (i.e. the dimension in line with the direction in which a blank is moved along the conveyor TC), and the pawls on one such carrier 87 are laterally aligned with those on the other such carrier 87.

The movable frame 81 is formed in two sections 82 (FIGS. 6A and 6C) and 83 (FIG. 6D), the section 82 extending from the rollers 70, 72 to a position just short of the left hand end (as viewed in FIG. 1) of the unit FU, and the section 83 extending from the other end of unit FU to a position a short distance before position A. For convenience of illustration and description the right hand end portion (considered in the direction of movement of blanks along the conveyor TC) is shown in FIG. 18A.

The sections 82, 83 of the frame 81 are similar in construction so only the section 82 will be described in detail, but the references used in describing section 82 are also shown in the drawings on section 83.

The section 82 comprises two bars 94, 95 spaced apart, as shown in FIG. 7, and two guides 96, 97 which are spaced apart between the bars 94, 95, the bars 94, 95 and the guides 96, 97 all extending along the whole length of the section 82. The bar 95 and guides 96, 97 are suspended, by brackets 98 fixed at intervals thereon, by a pair of support plates 99. The bar 94 is supported from the bar 96 by means of a number of spacer bars 100.

The bars 94, 95 each have a number of blocks 101 mounted on them at equally spaced positions along their length, and pivoted to each block 101 is a driving pawl 102 provided with a hooked finger 103. The frame 81 is mounted above the frame 80 so that the hooked fingers 103 of the pawls 102 extend downwardly below the frame 81. The pawls are normally held in this position (i.e. the position shown in FIGS. 6A, 6C, 6D and 7) by leaf springs 104, the extent of the downward movement of the pawls being limited by the pawls abutting against a sloping surface provided on each block 101 (as shown in FIGS. 6A, 6B and 6D). The spacing of the pawls 102 along the bars 94, 95 is equal to the spacing of the pawls 90 along the carriers 87, and the pawls 102 on the bar 94 are laterally aligned with those on the bar 95.

The fingers 103 of the pawls 102 mounted on the bar 95 extend downwardly into a groove 105 formed in the plate 84 and the fingers 103 of the pawls 102 mounted on the bar 94 extend downwardly into a groove 105a formed by overlapping the adjoining edges of the plates 84, 85, as shown in FIG. 7.

The sections 82, 83 of the frame 81 are each carried on a common beam 106 by means of their respective support plates 99 which are all fixed to the beam 106. Pivotally connected to the beam 106, near the right hand end thereof (as viewed in FIG. 6D) is one end of an arm 107. Respectively pivoted at 108, 109 on the arm 107 are two links 110, 111 which are connected respectively to fixed pivots 112, 113 journalled in the fixed part 89 of the machine. Fixed to a drive shaft 114 is a crank arm 115, to which is pivoted one end of a connecting link 116, the other end of which is also pivotally connected to the arm 107 at 109. The beam 106 is supported, near its left hand end (as viewed in FIG. 6A) by an arm 117 and two links 118, 119, which correspond respectively to the arm 107 and links 110, 111. The shaft 114 is driven continuously in a clockwise direction (as viewed in FIG. 6D) and the various arms and links cause the moving frame 81 to be reciprocated above the fixed frame 80, the arrangement being such that on each forward movement (i.e. to the right as viewed in FIGS. 6A, 6C and 6D) of the frame 81 the driving pawls 102 are moved a distance which is slightly greater than the distance between successive pawls 90 on the carriers 87.

The unit FU is shown in FIGS. 6C and 6D and consists of a number of upper continuous bands 120 and lower continuous bands 121 between adjacent runs of which blanks are fed as will be described later. To allow this the bands 121 run in slots formed in the plates 84 and 85. Only one of each of the bands 120, 121 can be seen in FIGS. 6C and 6D, the others being spaced apart across the width of the plates 84. The bands 120, 121 are driven continuously by rollers 122, 123 respectively, in the direction shown by the arrows, at a linear speed in excess of the maximum forward speed of the pawls 102. At the entry end (the left hand end as viewed in FIG. 6C) of the unit FU a guide 124 is provided adjacent each of the upper bands 120 and at the exit end (FIG. 6D) of the unit FU springs 125 are provided to retard the blanks as will be described later. The unit FU also includes a plough folder 159 of conventional form for folding part of a blank being fed by the bands 120, 121, as will be described later, and a pair of pressure rolls 160.

The gumming device GD comprises two units 126, 127 (FIG. 6C) positioned at different locations along the fixed frame 80 to apply adhesive to various parts of a blank as will be described later. Each unit 126, 127 comprises respectively a number of adhesive applicator nozzles 128, 129 of the type having a spring loaded ball positioned in the nozzle to normally prevent adhesive from flowing therefrom. At certain times the nozzles are moved upwardly into contact with a blank which is pressed against anvils 130, 131, respectively mounted opposite the nozzles 128, 129, which causes the spring loaded balls to be depressed and adhesive to flow from the nozzles. The nozzles 128, 129 are carried respectively on bars 132, 133 and are moved towards and away from the adhesive application position by any convenient form of mechanism (not shown) working in synchronism with the movement of the movable frame 81.

A short distance along the conveyor TC from the rollers 70, 72 is a device 134 (FIG. 6A) which prints or embosses part of a blank with some form of identification mark or the like if the cigarette manufacturer so desires. The device 134 comprises a fixed upper part 135 and a movable lower part 136 (FIG. 6B), the upper part 135 carrying a platen 137 provided on its bottom face with the mark to be applied to the blanks, the bottom face of the platen 137 being held in a position slightly more than the thickness of one blank above the surface 86 of the fixed frame 80. Two leaf springs 138, only one of which is visible in FIG. 6A, are provided to prevent the blanks from fouling the platen 137 and also to ensure that the blanks to not adhere to the platen.

The lower part 136 comprises a pressure plate 139 (FIG. 6A) which is arranged to be lifted so as to press the blanks into contact with the platen 137. The pressure plate 139 is carried on a block 140 fixed to a slide 141, which is mounted for movement between two pairs of rollers **141*a*, 141*b*, rotatably carried on a fixed plate 141*c*. Pivotally connected at one end to the block 140, and at the other end to an arm 142, is a link 143. The arm 142 is fixed to a pivot pin 144 which also has a lever 145 fixed to it, the pivot pin 144 being journalled in the plate 141*c*. The end of the lever 145 remote from the pivot 144 carries a roller 146 which runs in a cam groove 147 formed in a disc 148 fixed to a shaft 149, which is driven continuously in an anticlockwise direction, as viewed in FIG. 6B.**

Positioned between the rollers 70, 72 and the device 134 is a first detector device 150 comprising two holders 151, 152 which are respectively mounted above and below the surface 86, as shown in FIG. 6A. The holder 151 contains four light sources 153 arranged in two pairs spaced apart across the width of the surface 86, the sources of each pair being spaced apart lengthwise of the surface 86, as shown in FIG. 10. The holder 152 contains four photo-electric cells 154, one cell being positioned opposite each light source 153. Positioned to the right, as viewed in FIG. 6D, of the unit FU is a second detector device 155 which is identical in construction and arrangement with the detector 150. A third detector 156, consisting of a micro-switch 157 operated by a lever which carries a roller 158, is positioned above the surface 86, as shown in FIG. 6A. The detector 156 is arranged so that the switch 157 is operated if more than one blank at a time is fed past it, as will be described later. Alternatively the detector 156 may be positioned between the rollers 70, 72 and the first detector 150.

OPERATIOIN FOR BLANK CONVEYOR

The operation of the conveyor TC and its associated devices will now be described. Blanks are fed in succession by the belts 66, 67 on to the surface 86 of the fixed frame 80, the blanks then being fed intermittently to the position A by the movable frame 81. As all the blanks are treated in the same way the passage of one blank along the conveyor TC will be described.

A blank is fed, by the bands 66, 67, on to the surface 86, the blank being orientated so that its width, i.e. the dimension indicated at W in FIG. 2, extends in the direction of the blank is being fed.

With the blank in the position shown at X in FIG. 6A the movable frame 81 is at the extent of its movement to the left, but on continued rotation of shaft 114 the crank 115, link 116 and two sets of linkages 107, 110, 111 and 114, 118, 119 cause the frame 81 to start moving to the right. Due to the crank drive of the frame 81 the linear speed of the latter will vary cyclically, whereas the linear speed of the blank, whilst under the influence of the bands 66, 67, is greater than the maximum speed of the frame 81. With this arrangement, irrespective of the width of the blank, the blank is never engaged by the left hand pair of drive pawls 102 (as viewed in FIG. 6A) until the trailing edge of the blank has moved clear of the belts 66, 67. When the blank reaches a position approximately corresponding to the position X, the circuitry associated with the first detector device 150 is switched on and under normal operating conditions the upstream pair of photoelectric cells 154 will be dark, due to the leading edge of the blank passing between them and their associated light sources 152, and the downstream pair of cells 154 will be illuminated as the trailing edge of the previous blank will already have passed beyond the position at which it shuts off the light from the associated sources 153, as shown in FIG. 10. If, however, either or both the upstream cells 154 is illuminated or either, or both, the downstream cell 154 is dark then one or more blanks has become misplaced and the machine is stopped, the circuitry required being of any convenient known form.

When the trailing edge of the blank passes out of the nip of the belts 66, 67 it is engaged, at spaced positions along its length, by the fingers 103 of the first pair of driving pawls 102 carried on the section 82 of the frame 81, the fingers 103 running along the grooves 105, 105*a*. When the frame 81 reaches the end of its movement to the right, the blank comes to rest slightly in front of the first pair of pawls 90 carried on the fixed frame 80. On the next rearward movement of the frame 81 the pawls 102 engage the leading edge of the next following blank, and the fingers 103 are lifted clear of the grooves 105, 105*a*, and slide along the upper face of the next following blank, (FIG. 8A). Whilst the fingers 103 are sliding over the blank they cause the blank to move slightly back into engagement with the pawls 90 which projects above the surface 86. The frame 81 and pawls 102 continue their rearward movement until the fingers 103 drop off the trailing edge of the said following blank, the fingers 103 again entering the grooves 105, 105*a*, and then start to move forward again and engage the trailing edge of the blank (FIG. 8B) over the upper face of which they have just returned. Continued movement of the frame 81 causes this blank now to be pushed to the right (FIG. 8C), the projecting part of the next succeeding pair of pawls 90 being moved below the surface 86 by the blank (FIG. 8C), until they are again projected above the surface 86, by springs 92, after the trailing edge of the blank has passed over them. The above operations are repeated cyclically so that each blank progresses, from one set of pawls 90 to the next, along the conveyor TC.

After leaving the bands 66, 67 and being advanced further in steps by the frame 81 as described above, the blank comes to rest at a position between the parts 135, 136 of the device 134. Rotation of disc 148 causes the pressure plate 139 to press the blank against the platen 137. The device 134 is so positioned that the identification marks it applies are printed or embossed on the panel P18 of the blank (FIG. 2).

Prior to coming to rest after the next movement of the frame 81 the blank is moved beneath the roller 158 of the third detector device 156. The roller 158 is positioned so that if more than one blank at a time passes beneath it, it will be raised and the micro-switch 157 operated and the machine will be stopped. If only one blank passes beneath roller 158, the machine carries on operating normally. After two more cyclic operations of the frame 81 the blank comes to rest at the position adjacent the gumming unit 126, at which position the bar 132 is moved to lift the nozzles 128 into contact with the blank, and by reason of the anvil 130 causing the balls mounted in the nozzles 128 to be depressed, adhesive flows from the nozzles, as described previously, on to the blank. The blank is so positioned on the surface 86, relative to the nozzles 128, that adhesive is applied to panels P14 and P19 (FIG. 2).

On the next movement of frame 81 the blank comes to rest at a position adjacent the gumming unit 127 and on moving the bar 133, the nozzles 129 and anvils 131 cooperate to apply adhesive to the panels P5, P6, P9 and P10. If required, adhesive may also be applied at this position, to the panels P15 and P18.

On the next movement of the frame 81, the right hand (as viewed in FIG. 6C) end drive pawls 102 of section 82 push the blank into the nip of the bands 120, 121, the guide 124 ensuring that the leading edge of the blank does not foul against the bands 120, 121. The blank is gripped between the bands 120, 121 and fed at a higher linear speed than the maximum speed of the frame 82, thus pulling the trailing edge of the blank away from the pawls 102.

Whilst being fed by the bands 120, 121 the panel P1 is folded over 180°, by the plough folder 159, into contact with the panel P14 and stuck thereto by the adhesive previously applied by gumming unit 126. The panel P1 is pressed against the panel P14 by the pressure rolls 160, between which these panels pass.

After being ironed by the rolls 160 the blank progressively passes out from between the bands 120, 121 and when it reaches approximately the position shown at Y in FIG. 6D the movable frame 81 starts to move to the right (as viewed in FIG. 6). To enable the left hand (FIG. 6D) end pawl 102 of the section 83 of the frame 81 to catch up with the blank after the trailing edge thereof passes out from the nip of bands 120, 121, the blank passes beneath the springs 125 which press on it to reduce its speed over the surface 86. Also, when the blank reaches position Y the circuitry associated with the second detector device 155 is switched on, and any misplaced blank is detected, as described earlier with reference to the first detector device 150.

After the blank has passed out of the nip of the bands 120, 121 it is engaged by the fingers 103 of the first pair of driving pawls 102 carried on the section 83 of the frame 81, and the blank continues to be fed intermittently by successive pawls 102 on section 83 until it reaches the position A, the blank being moved to this position by the driving pawl 102 mounted at the right hand end of the section 83, which is shown in FIG. 18A.

BUNDLE FEED

The apparatus for transferring bundles of wrapped cigarettes from the conveyor BC to the drum BD, and the drum BD itself, will now be described with reference to FIGS. 11 to 17.

The conveyor BC receives foil-wrapped bundles of cigarettes from the apparatus BM, may be of any convenient form, and is driven intermittently, in the direction of the arrow M (FIG. 11), from a drive unit (not shown) of any convenient form. The arrangement is such that each time the conveyor BC comes to rest, two wrapped bundles of cigarettes are delivered to positions adjacent the positions indicated in FIGS. 11 and 13 at PO1, PO2. The bundles are moved from the conveyor BC to the positions PO1, PO2 by the pusher 161 (FIG. 13) which is carried on one end of a two armed lever 162, pivoted at 163, the other end of the lever 162 carrying a cam follower 164 which engages a continuously rotated cam 165.

When in the positions PO1, PO2 the bundles are resting on a fixed plate 166, mounted below the drum BD. The plate 166 is provided with two apertures 167, 168 through which platforms 169, 170 are moved respectively to lift the bundles from positions PO1, PO2 into the drum BD, as will be described later.

The platform 169 is pivotally carried on one end of each of two links 171, 172. The other end of link 171 is pivotally connected to the free end of one arm 173 of a bell crank lever 174 fixed to a shaft 175. The other arm 176 of the lever 174 is pivoted to one end of a short link 177. The other end of the link 172 carries a roller 178 which is arranged to run in a slot 179 provided in a fixed block 180. The link 172 is pivoted at 181 to the arm 173.

The other platform 170 is carried in a similar manner to the platform 169, by links 182, 183 carried on one arm 184 of a bell crank lever 185 freely pivoted to a shaft 186. The other arm 187 of the lever 184 is pivoted to the other end of the short link 177.

Also fixed to the shaft 175 is a double armed lever 188 the free ends of which carry a roller 186, 190 respectively, the rollers respectively contacting cam 191, 192 fixed to a drive shaft 193 continuously rotated in an anti-clockwise direction, as viewed in FIG. 11.

The drum BD comprises a centre section 194 fixed to a shaft 195, which is journalled in a cylinder 196 connected to a fixed part of the machine, and driven intermittently in a clockwise direction, as viewed in FIG. 11, (anti-clockwise as viewed in FIG. 12) in 36° steps, by any convenient form of drive means shown diagrammatically in FIG. 13, at 197. Fixed to, and spaced equally around, the periphery of the centre section 194 are ten blocks 198, each of which is provided with two apertures 199, 200 which extend through the blocks 198, radially outwards from the centre section 194. Slidably mounted in each of the apertures 199 is a slide 201, each slide carrying near its inner end (the end nearest the centre section 194), a roller 202 which projects through a slot in the block 198. The rollers 202 engage in a continuous slot 203 formed in the right hand face (as viewed in FIG. 13) of a cam 204 which is mounted for limited angular rotation on the cylinder 196, as will be described later. Fixed to the outer end face (i.e. the face furthest from the section 194) of each slide 201 is a pocket 205. Except in one small detail all ten pockets 205 are identical, so only one will be described in detail.

The pocket 205 comprises a base plate 206 which is fixed to the slide 201, and provided with two holes 207, 208. The pocket also has four side walls 209, 210, 211, 212, the wall 210 being in the form of an angle bracket fixed to a block 213. The side walls 209, 211, 212, and block 213 are respectively fixed to shafts 214, 215, 216, 217 which are journalled in the base plate 206 so that each shaft is mounted adjacent to, and parallel with, one side of the base plate 206, as shown in FIG. 15, the block 213 extending through the hole 208. Each of the shafts 214 to 217 also has two bevel gears 218 fixed to it, one at each end of the side walls 209, 211, 212 and block 213 the bevel gears at adjacent ends of neighbouring side walls being in mesh as shown in FIG. 15 so that when the shaft 215 is rotated, as will be described later, the other three shafts 214, 216, 217 also rotate, thus swinging the side walls 209 to 212 in unison about the axis of the shaft they are fixed to, the walls 209, 210 swinging respectively towards or away from the walls 211, 212, depending on the direction of rotation of the shaft 215.

Each of side walls 209 to 212 is provided respectively with a thin plate 219, 220, 221, 222, carried on respective shafts 223, 224, 225, 226, which extend through the side walls 209 to 212 parallel with the shafts 214 to 217, by means of tail pieces 227 which are wrapped round the shafts 223 to 226, as shown in FIGS. 11, 12, 15 so that the plates 219 to 222 hinge on the shafts 223 to 226. The plates 219 to 222 are arranged so that they extend in front of those faces of the walls 209 to 212 which face the inside of the pocket 205, and are urged away from those faces by means of springs 228, as shown in FIGS. 13, 15, the amount of movement caused by the springs being limited by projections 229 on the plates 219 to 222 which are shaped, as shown in FIG. 15, to extend round the ends of the side walls 209 to 212 and contact the outside faces thereof.

Freely pivoted on the shaft 214 is a lever 230 to which is pivotally connected one end of a strip 231, the other end of the strip being pivoted to a short link 232, the link 232 being fixed to the shaft 215, as shown in FIG. 12.

Each of the levers 230 is provided with a roller, the levers 230 of alternate pockets 205 each carrying a roller 233, and the levers of the intermediate pockets 205 carrying a roller 234 the rollers 233, 234 being mounted on opposite sides of the levers 230, as shown in FIGS. 13 and 14. The pockets 205 are positioned so that the rollers 233, 234 contact the peripheral surface of the cam 204, the rollers being kept in contact therewith by means of torsion springs 235, one of which is shown in FIG. 15. With the arrangement just described the rollers 233, 234 trace out different paths on the cam 204, for reasons to be explained later.

The left hand face (as viewed in FIG. 13) of the cam 204 is cut away at approximately the six o'clock position to form a recess 236. Pivotally mounted at 237, 238 to the cam 204, and contained within the recess 236, are two segments 239, 240 respectively. The segments are respectively provided with rollers 241, 242 which contact cams 243, 244, the cams being non-rotatably fixed to the cylinder 196. The segment 239 is provided with an extension 245, the recess 236 being made deeper adjacent the segment 239 to accommodate the extension 245, as shown in FIG. 13. The arrangement is such that with the segments in the positions shown in FIG. 12 their outer surfaces form a part of the peripheral surface of the cam 204, but as viewed in FIGS. 13, 14 the segments 239, 240 extend respectively across about one half and one third of the width of the cam 204.

Each of the pockets 205 is also provided with a platform 246 fixed to one end of a further slide 247 which extends through the aperture 207 and is slidably mounted in the aperture 200 of the block 198. Near the other end (i.e. the end nearest the centre section 194) of the slide 247 and rotatably mounted thereon is a roller 248 which projects through a slot in the block 198 and engages in a continuous slot 249 formed in the left hand face (as viewed in FIG. 13) of a disc 250 which is freely mounted for limited angular rotation on, but independently of, the shaft 195.

Pivotally connected, at one end, to the left hand face (as viewed in FIG. 13) of the cam 204 is a link 251 (FIGS. 12 and 13), the other end of which is pivotally connected to one arm of a bell-crank lever 252 pivoted on a shaft 253, an extension of the one arm carrying a roller 254 which engages a cam 255. The other arm of the lever 252 carries a roller 256 which engages a cam 257. The cams 255, 257 are carried on a common boss which is fixed to a shaft 258 driven continuously from drive means (not shown), in an anti-clockwise direction, as viewed in FIG. 11 (clockwise as viewed in FIG. 12).

The disc 250 (FIG. 11) has pivotally connected thereto one end of a link 259, the other end being connected to a bell crank lever 260, also pivoted on the shaft 253, which lever carries two rollers 261, 262 which engage cams 263, 264 respectively, these cams being carried on a common boss which is also fixed to the shaft 258.

OPERATION OF BUNDLE FEED

The operation of the apparatus of FIGS. 11 to 17 will now be described.

In the drawings, a wrapped bundle of cigarettes has just been delivered, as previously mentioned, to each of the positions PO1, PO2 by the pusher 161, the bundles being positioned respectively over the platforms 169, 170. Also the drum BD has just come to rest so that a pocket 205 is positioned above each of the bundles at positions PO1, PO2. (It will be remembered that, as viewed in FIG. 11, the pockets 205 are moved in a clockwise direction by the shaft 196, whereas as viewed in FIG. 12 the pockets 205 are moved in an anti-clockwise direction). The lever 230 carried on the pocket 205 positioined above the position PO1 carries a roller 234, and the lever 230 carried on the pocket 205 positioned above the position PO2 carries a roller 233, the rollers 234, 233 contacting the surface of the segments 240, 239 respectively, the roller 233 being in contact with the extended part 245 of the segment 239, as shown in FIGS. 12, 13 and 16. Under the conditions just described the segments 239, 240 are in such a position that their surfaces form a part of the peripheral surface of the cam 204, as is shown in FIG. 12, the side walls 209 to 212 of the two pockets 205 being considered are held in their innermost position (the walls 210, 212 being shown in this position in FIG. 13), and the platform 246 is in the position shown in FIG. 13.

Whilst the centre section 194 of the drum BD, and thus the pockets 205, remain stationary, rotation of the cams 255, 257 causes the cam 204 to be rotated clockwise, as viewed in FIG. 12, about the cylinder 196, through a limited angle, depending on the profiles of the cams 255, 257. As the cam 204, moves, the segments 239, 240 move with it, and the rollers 241, 242 run around their respective cams 243, 244, which are so shaped that the segments 239, 240 are caused to swing about their respective pivots 237, 238 in an anti-clockwise direction, as viewed in FIG. 12, so that their right hand ends, as viewed in FIG. 12, move inwardly from the peripheral surface of the cam 204. This movement of the segments 239, 240 allows the torsion springs 235 to move the levers 230 clockwise, as viewed in FIG. 12, on the shafts 214, which movement causes, in turn, through the strips 231 and short links 233, the shafts 215 to rotate. Through the bevel gears 218, rotation of shaft 215 causes rotation of the shafts 214, 216, 217, the rotation being in such a direction that the side walls 209 to 212 move outwardly about the axes of the shafts 214 to 217.

At the same time as the cam 204 is rotated, as described above, the disc 250 is rotated on the shaft 195 anti-clockwise, as viewed in FIG. 11, through a limited angle, as the cams 263, 264 rotate. This movement of the disc 250, and thus the slot 249, causes no movement of the platforms 246 in the two pockets 205 being considered because the slot 249 is concentric about the shaft 195 over approximately the lower 180° (as viewed in FIG. 11) of its path.

Simultaneously with the rotational movement of the cam 204 and disc 250, rotation of the cams 191, 192 causes the two bundles of cigarettes at positions PO1, PO2 to be lifted respectively, on their platforms 169, 170, about the shafts 175, 186. As the bundle from position PO1 is lifted the roller 178 runs along the slot 179 and the bundle will be tilted, so that by the time it is adjacent a pocket 205 it will be so positioned that it can be pushed into the pocket radially of the drum BD. By the time the bundle reaches this position the side walls 209 to 212 will have been moved to the limit of their outward movement, to allow the bundle to enter the pocket easily. It will be appreciated that the bundle from position PO2 is lifted into a pocket 205 in the same manner, and at the same time as, the bundle from position PO1, this bundle being however tilted in the opposite sense.

After the bundles have fuly entered the pockets 205, further rotation of the cams 255, 257 and 263, 264 cause the cam 204 and disc 250 respectively to rotate back to their original positions (i.e. the positions shown in FIGS. 12 and 11 respectively). Rotation of the disc 250 has no effect on the pockets 205, for the reason stated above, but rotation of the cam 204 causes the rollers 241, 242 to run back along the cam 243, 244 respectively and the segments 239, 240 to return to the positions shown in FIG. 12. This movement causes the levers 230 to return to their original position and thus the side walls 209 to 212 of the pockets in which the bundles have just been placed will move inwardly towards the bundles which will be gripped by the plate 219 to 222 being resiliently pressed against the sides of the bundles, now contained in the pockets 205, by the springs 228. Further rotation of the cams 191, 192 causes the platforms 169, 170 to return to their original positions as shown in FIG. 11.

The centre section 194 of the drum BD, and thus also the pockets 204, are now rotated by the drive means 197 through an angle of 36° and then stopped. During this movement the rollers 233, 234 run off the part 245 of the segment 239, and the segment 240 respectively so that when the pockets come to rest the rollers 233, 234 are both in contact with the peripheral surface of the cam 204, as shown in FIG. 17. Whilst the pockets are at rest, the sequence of operations described above with respect to the cam 204 and disc 250 is repeated, but neither of the pockets 205, which received the bundles of cigarettes from positions PO1, PO2, will be affectetd, nor are the platforms 169, 170 lifted. This is due to the fact that the cams 191, 192 are so shaped and driven that the platforms 169, 170 are only moved to transfer two bundles of cigarettes into two pockets 205 on the drum BD, after every second stepwise movement of the drum BD, as it is only then that there are two empty pockets 205 positioned above the platforms 169, 170.

It will be apparent that if the segment 240 extended the same distance across the width of the cam 204 as the segment 239 the side walls 209 to 212 of the pocket 205 carrying a roller 233, would open on operation of the segment 240 and the bundle held in the pocket would fall out.

After a further stepwise movement of the centre section 194, the pocket 205 which contains the bundle of cigarettes which were transferred into it from position PO1, as described previously, will come to rest at position D (FIGS. 1, 11, 12). Whilst the pocket is stationary at position D, the cam 204 and disc 250 are rotated by the pairs of cams 255, 257, and 263, 264 respectively, as described previously. As the cam 204 rotates clockwise, as viewed in FIG. 12 the sides of the slot 203 act on the roller 202 to move the slide 201, and thus the pocket 205, and the cigarette bundle contained therein, radially outwards of the drum BD towards the drum FD. At the same time the disc 250 is moved anti-clockwise, as viewed in FIG. 11, and the form of the slot 249 is such that the roller 248, further slide 247 and platform 246 are moved radially outwards of the drum BD, in unison with the pocket 205. The actual insertion of the wrapped bundle of cigarettes into a partly formed packet being carried on the drum FD will be described later when describing the operation of the drum FD with reference to FIGS. 18 to 30.

PACKET FORMING DRUM

The packet forming drum FD, its associated devices, and the stacking unit SU will now be described in detail with reference to FIGS. 18 to 23.

The plates 84, 85, previously described with reference to FIGS. 5 to 10, extend a short distance to the right, as viewed in FIG. 18A of the position A, and near the right hand end thereof a plate 270 is fixed to, and extends across, the width of the plates 84, 85. Fixed to the underside of the plates is a box 271, an aperture 272 being provided in the top of the box 271 and in the plates 84, 85.

Positioned in the box 271 are three lifting blocks 273, 274, 275, the block 274 being positioned between the blocks 273, 275 (FIGS. 18A, 20), the three blocks being movable up and down through the aperture 272, as will be described later. The centre block 274 is carried on a slide 276 which is arranged to be moved up and down between two pairs of guide rollers 277, 278. Pivotally connected, at one end, to the slide 276, is a short link 279, the other end of which is attached to one arm 280 of a bell crank lever pivoted at 281. The other arm 282 of the bell-crank lever carries a roller 283 which engages in a slot 284 formed in one face of a box cam **284*a* fixed to a shaft 285 which is continuously rotated in a clockwise direction, as viewed in FIG. 18A.**

Also pivotally connected to the slide 276 is one end of an L-shaped arm 286. The two blocks 273, 275 are fixed to a common carrier 287 having a downwardly depending lug 288 to which one end of a connecting link 289 is pivotally attached. The other ends of the arm 286 and link 289 are carried on a common pivot which carries a roller 190. The roller 290 is arranged to engage in a slot 291 formed in a block 292 fixed to a partition (not shown) in the box 271. Fixed respectively to separate shafts 293, 294 are two lifting plates 295, 296, the shafts 293, 294 being driven continuously in a clockwise direction as viewed in FIG. 18A.

Positioned a short distance above the fixed frame 80, so that they extend over the lifting block 273 are two folders 297, 298 and two tuckers 299, 300 (FIGS. 18A, 20). The folders are arranged to extend in a plane parallel to the fixed frame 80 and the tuckers extend downwardly, at right angles to the folders, as shown in FIG. 18, both the folders and tuckers being carried on a bridge plate 301 which extends across the width of the fixed frame 80. Similar pairs of folders 302, 303 and tuckers 304, 305 are arranged to extend over the lifting block 275, both the folders and the tuckers being carried on a bracket 306 fixed to the plate 270.

The drum FD includes a structure 307 (FIG. 19) non-rotatably secured to a fixed part of the machine. Rotatably mounted on a flange 308, formed on the structure 307, is an annular carrier 309, made up of two coaxial annular parts which are fixed together by bolts (not shown). Fixed to the carrier 309 is a ring 310 having gear teeth formed on its inner surface (FIGS. 18, 19). The teeth of the ring 310 mesh with the teeth of a gear wheel 311 fixed to a shaft 213 (FIG. 18) which is driven intermittently from any convenient form of drive means (not shown). Fixed to, and equally spaced round, the carrier 309, are nine pockets 313, each of which is supported at its end remote from the carrier 309, on the outer end of one arm 314 of a nine-armed spider 315 journalled on a stub shaft 316. The arrangement is such that the carrier 309, and thus the pockets 313, are rotated about the flange 308 by the gear wheel 311 in 40° steps in an anti-clockwise direction (as viewed in FIG. 18). Each pocket consists of a base plate 317 provided with an aperture 318, and four side walls 319, 320, 321, 322, the edges of these walls, which define the mouth of the pocket, being chamfered as shown in FIGS. 18, 18A, 19.

A pusher 323 is provided, between the spider 315 and the carrier 209, which is arranged to be reciprocated radially of the carrier 309 so as to pass through the aperture 318 of each pocket 313 in turn. For this purpose the pusher 323 is fixed on a slide 324 which moves between two pairs of guide rollers 325, 326, rotatably mounted on a cross piece 327. The cross piece 327 is carried on a number of legs 328 which are bolted to a wall 329 (FIG. 19) of the structure 307. The cross piece 327 also provides a fixture for a hub 330 in which the stub shaft 316 is journalled. Rotatably fixed at one end, to the slide 324, is a connecting arm 331, the other end of which is journalled on a pin 332 carried on a crank disc 333. The disc 333 is fixed to the left hand end (as viewed in FIG. 19) of a short shaft 334 journalled in a boss carried on arms 335 which are bolted to the wall 329. The right hand end of the shaft 334 is formed into a block 336 which has a shaft 337 fixed to it, the shaft extending radially outwards from the shaft 334. Slidably mounted on the shaft 337 is a bush 338 provided with a pin 339, which is journalled in a further crank disc 340, the latter being fixed to a shaft 341 driven continuously from any convenient form of drive means (not shown), the shaft 341 being offset from the shaft 334, as shown in FIG. 19.

The shaft 341 is driven in an anti-clockwise direction (as viewed in FIG. 18), and thus the cranks 340, 333 are driven in the same direction. The various parts constituting the drive to the slide 324 are so arranged that, considered in the direction of rotation of the cranks 340, 333, the pin 332 is approximately 30° in advance of the pin 339.

Also mounted between the spider 315 and the carrier 309 is a device 359 for applying lines of hot-melt adhesive to certain panels of each blank. The device 359 is constructed as described in U.S. patent application Ser. No. 308,097, now U.S. Pat. No. 3,815,822 and will not be further described here.

Mounted outside the pockets 313, in a direction radial of the carrier 309, and extending round the drum FD over an angle of approximately 40° from the bracket 306 is a pair of arcuate plates 342 (FIGS. 18, 18A, 20). Also mounted outside the pockets 313, and extending over an angle of approximately 80°, are a number of plough folders 343, of conventional form, only one of the folders being shown in FIG. 18. Positioned at the trailing end of the folders 343 (considered in the direction of rotation of the carrier 309) is a flap folding mechanism 344. The latter consists of two folders 345, 346 (FIG. 23). The folder 345 is pivoted to an extension 347 fixed to a frame 348. Also pivoted to the extension 347 is one end of a lever 349, the other end being connected to a link 350 which in turn is pivotally connected to the folder 345. Pivotally connected to the lever 349, near its connection with the link 350, is a connecting arm 351. The folder 346 is pivotally connected to a further extension 352 fixed to the frame 348. A lever 353 and link 354 are connected together in the same manner as the lever 349 and link 350. A further connecting arm 356 is pivotally connected to the lever 353. The connecting arms 351, 356 are each operated by a pair of cams (not shown) which cooperate to move the folders 345, 346 as will be described later.

Facing the adhesive applying device 359 (FIG. 18) but positioned radially outwards of the pockets 313 is a plate 360, which is movable towards and away from the pockets 313, by a pair of cams (not shown) at certain times, as will be described later.

STACKING UNIT

Mounted outside the drum FD and in radial alignment with the pusher 323 is the entry end of the stacking unit SU (FIGS. 18, 20, 21). Extending between the flap folding mechanism 344 and the plate 360 and between the plate 360 and the entry end of the unit SU are two fixed arcuate plates 357, 358 respectively.

The unit SU consists of upper and lower back plates, attached to a fixed part of the machine, of which only the upper one, indicated at 361, is visible in the drawings. Carried on the back plate 361 is a bracket 362 from which a rectangular plate 363 is supported, at one end thereof, by means of a spring 364. The other end of the plate 363 is fixed to a bracket 365 hinged at 366. Freely pivoted in a slot 367, in the plate 362, is a triangular member 368, one side of which engages a stud 369 fixed to the plate 363. A second side of the member 368 is engaged by a cap fitted to the end of the piston rod 370 of a pneumatic cylinder 371. Carried on the plate 363 is a heater block 372 provided with heater elements 373 and a thermostat 374, the heater block 372 extending through a hole in a pressure plate 374*a*. Also carried on the back plate 361 is an angle piece 375. Supported from the angle piece 375 by bolts 376 is a front plate 377 which is resiliently mounted with respect to the piece 375 by spring washers 378, the position of the plate 377 being determined by the bolts 376. The lower back plate carries a similar construction of parts, as just described with respect to the upper back plate 361, of which only a heater block 379, pressure plate 380, part of an angle piece 381, and front plate 382 are shown in FIG. 21.

The unit Su is also provided with two side walls 383, 384 which are carried on bolts screwed into support arms 385, 385 respectively, the side walls 383, 384 being resiliently mounted with respect to the arms 385, 386 by means of spring washers 287 positioned between opposing faces of the walls 383, 384 and their respective support arms 385, 386 (FIG. 22). The arrangement is such that the front plates 377, 382, pressure plates 374, 380 and side walls 383, 384 form a passage 388 through which completed packets are pushed, as will be described later.

Positioned at the entry end of the unit SU is a pair of control flaps 389, 390 carried respectively on links 391, 392 which form part of two parallelogram linkages 393, 394 pivotally connected to brackets 395, 396. Short links 397, 398 are fixed, at one end, to one of the pivots on brackets 395, 396 respectively, and at the other end are pivotally connected to one end of each of a pair of operating arms 399, the latter being pivotally connected together, at their other ends, at 400. Also connected to the pivot at 400 is a lever 401 which is operated by a pair of cams (not shown), as will be described later. The control flaps 389, 390 extend towards each other from the links 391, 392, the free ends being provided with fingers which mesh so that when in the position shown in FIGS. 18, 21 the flaps 389, 390 lie in the same plane.

The support arm 386 is hinged at 405 to a fixed part of the machine which carries a micro-switch 406, the arm 386 being provided with an extension 407 which engages the switch 406. The arrangement is such that when the arm 386 is swung about the hinge 405 the micro-switch 406 is operated to energise devices (not shown) which operate to cause all the packets contained in the unit SU to be ejected at a later stage (e.g. from the unit PO, to be described later).

At the exit end of the passage 388 in the unit SU (i.e. the left hand end as viewed in FIG. 21) a chute 402 is provided which extends downwardly from the unit SU as shown in FIG. 21. A plunger 403, carried on a parallelogram linkage 404, is caused to move, by a pair of cams (not shown), downwards through the chute 402 and back up along a path which takes it outside the chute.

BLANK FOLDING OPERATIONS

The operation of the apparatus shown in FIGS. 18 to 23 will now be described with added reference to FIGS. 24 to 29.

Figure 24:
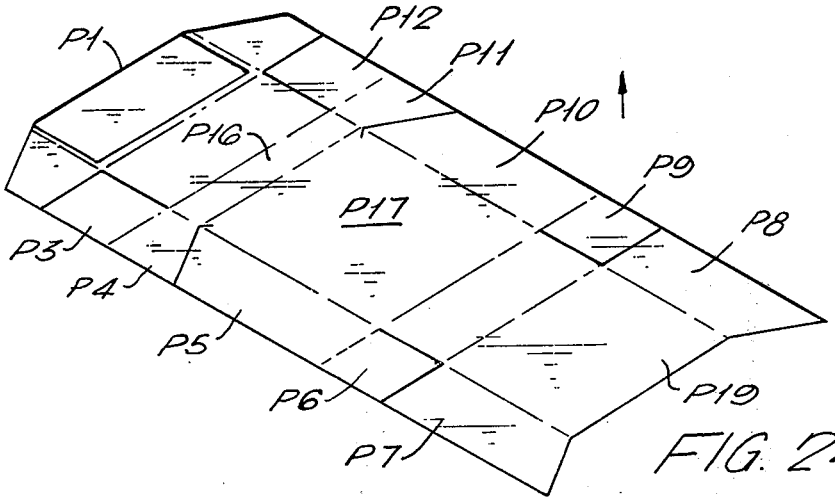

As previously mentioned, when describing the conveyor TC, with reference to FIGS. 5 to 10, each blank in turn is delivered to the position A. With a blank in this position its leading edge (considered in its direction of movement along the conveyor TC) is abutted against the plate 270 (FIGS. 18A, 20), the panels P4, P5 being positioned above the block 273, the panels P10, P11 being positioned above the block 275, and the panels P16, P17 being positioned above the block 274. A perspective view of the blank at position A, looking up from below the blank is shown in FIG. 24.

Figure 25:
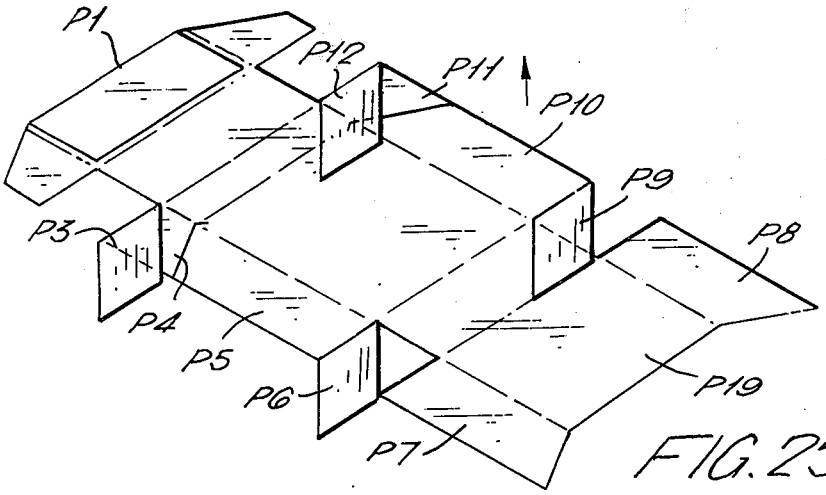

Starting with the various parts in the positions shown in FIG. 18A, rotation of the box cam 284a causes (through slot 284, roller 283 arms 280, 282 and link 279) the slide 276, and thus the block 274, to move upwards. This movement of the slide causes simultaneous upward movement of blocks 273, 274, through the arm 286, link 289, lug 288 and carrier 287, the blocks 273, 274 being constrained to move upwards in unison with the block 275 by reason of the roller 283 moving along the straight portion of the slot 291. The blocks 273, 274, 285 move upwardly through the aperture 272 and lift the blank at position A off the surface 86 of the fixed frame 80. As the blank is lifted the panels P6, P9 engage the tuckers 300, 305 respectively, and slightly later the panels P3, P12 engage the tuckers 299, 304 respectively, so that the panels P6, P9, P3, P12 are each folded downwardly through 90°, over the adjacent corners of the blocks 273, 275, as shown in FIG. 25 which is a perspective view taken from the same viewpoint as FIG. 24.

Figure 26:
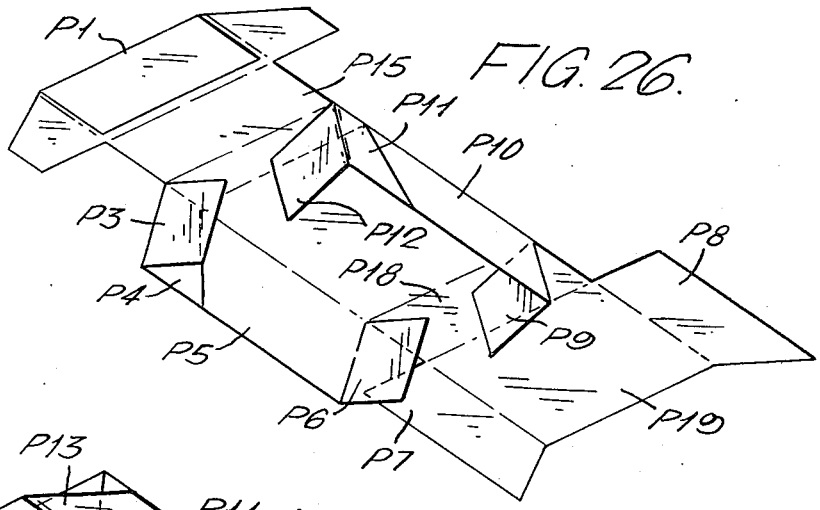
Figure 27:
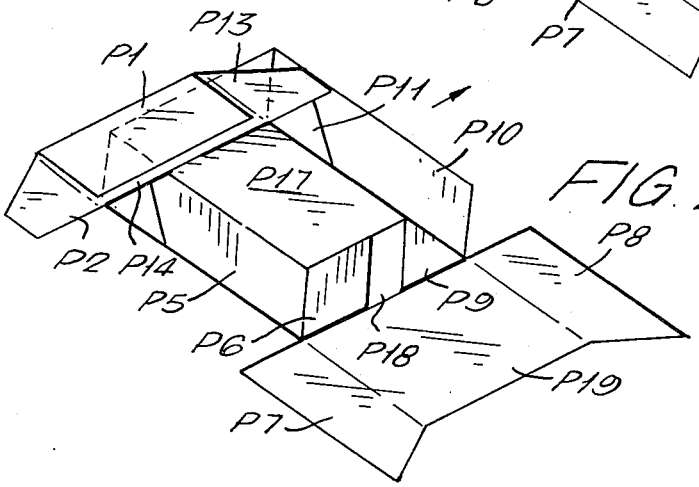
Figure 28:
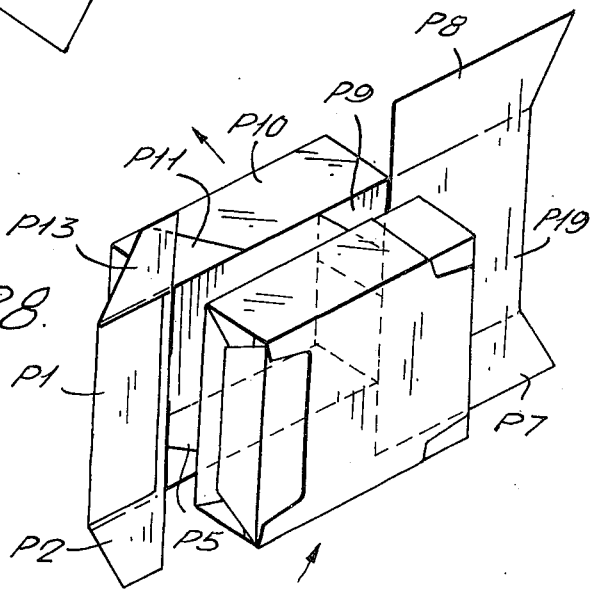

Upward movement of all three blocks 273, 274, 275 continues until the roller 290 reaches the end of the straight portion of the slot and starts moving along the curved portion. The curved portion is in the form of a circular arc which is centered upon the axis of the pivotal connection between link 289 and lug 288 when that axis is at the extent of its upward movement (i.e. when the roller 290 reaches the end of the straight portion of the slot 291). The block 274 continues moving upwardly, but due to the roller 290 now moving along the curved portion of slot 291, the link 289 swings about its connection with the lug 288 and the upward movement of the blocks 273, 275 is stopped. As the block 274 moves further upwards the panels P4, P5, engage the folders 297, 298 and the panels P10, P11 engage the folders 302, 303 so that the panels P4, P5, P10, P11 start to fold downwardly over the adjacent edges of the block 274. After further upward movement of the block 274 the panels P15, P18 respectively engage the walls 391, 321 of a pocket 313, of the drum FD positioned above the position A. At the same time the partly folded panels P4, P5, engage the wall 320 of the pocket, and the partly folded panels P10, P11 engage the wall 322 of the pocket. FIG. 26 shows a perspective view of a blank in this position, with the panels P4, P5, P10, P11 each having been folded through an angle of approximately 70°.

The block 274 continues its upward movement until the panels P16, P17 engage the base plate 317 of the pocket, by which time the panels P4, P5, P10, P11, P15 and P18 hhave all been folded through 90° and the blank is fully in the pocket 313. The blank is now a partly formed packet and such a packet is shown in perspective in FIG. 27.

On continued rotation of the box cam **284*a* the block 274 starts to move downwardly, and the roller 290, after moving back along the curved portion of the slot 291, enters the straight portion again and all the blocks 273, 274, 275 return to the position shown in FIG. 18**.

The drum FD is now rotated, through the gear wheel 311 and ring gear 310, through an angle of 40° and then stopped. As the pocket 313, now containing a partly formed packet starts to move, the panels P1 (which is stuck to panel P14) P2 and P13 engage the lower (as viewed in FIG. 20) plate 342 and the panels P7, P19 and P8 engage the upper (as viewed in FIG. 20) plate 342, the plates 342 being provided to keep the flaps which engage them in the position shown in FIG. 27.

To ensure that the panels P1, P2, P13 and P7, P19, P8 do not foul the edges of the respective plates 342 the lifting plates 295, 296 are rotated, their shape being such that they contact and lift the panels P1, P19 respectively.

After a further stepwise movement of the drum FD the pocket 313 containing the partly formed packet is brought to rest at position D, the open front of the partly formed packet facing the wrapped bundle of cigarettes in the pocket 205 of the drum BD. A partly formed packet and a wrapped bundle of cigarettes are shown in this relationship in FIG. 28. It will be remembered that when describing the operation of the drum BD with reference to FIGS. 11 to 17, it was left with the pocket 205, the cigarette bundle contained therein, and the platform 246, being moved in unison radially outwards of the drum BD, by rotation of the cam 204 and disc 250. The forms of the slots 203 and 249 are such that this movement continues until the edges of the thin plates 219 to 222 enter the partly formed packet contained in the pocket 313 at position D, at which time the movement of the pocket 205 is stopped. However, the platform 256 continues moving and pushes the bundle of cigarettes into the partly formed packet in the pocket 313, the plates 219 to 222 being moved on their respective shafts 223 to 226 against the spring 228, the plates 219 to 222 thus forming a mouthpiece through which the bundle of cigarettes is pushed.

The platform 246 moves only far enough to cause the bundle of cigarettes to engage the panels P16, P17. The cam 204 is now rotated clockwise (as viewed in FIG. 12) and the pocket 205 is moved away from the drum FD, thus withdrawing the plates 219 to 222 from the partly formed packet. When the plates are clear of the bundle the disc 250 is rotated clockwise (as viewed in FIG. 11) and the platform 246 is also moved away from the drum FD until the pocket 205 and the platform 246 have returned to their starting positions.

After two further stepwise movements of the drum FD the partly formed packet is brought to rest at position F (FIGS. 1, 18 and 23) adjacent the flap folding mechanism 344. During these movements of the partly formed packet from position D to position F the panels P2, P14, P13 and the panels P7, P19, P8 engage the plough folders 343 which progressively fold the flaps about the crease lines between each panel P14, P19 and the adjacent panels P15, P18 respectively, through an angle of approximately 110°. After the partly formed packet has been brought to rest at position F, the folders 345, 346 (FIG. 23) are caused to engage the panels P19, P14 respectively by rotation about their respective pivots on the extensions 347, 352, by operation of the connecting arms 351, 356 respectively. The cams which cause this rotation of the folders 345, 346 are so shaped that the folder 345 starts to move before the folder 346, so that the panel P19 is folded into engagement with the bundle of cigarettes slightly before the panel P14, to avoid any interference between the panels. After both panels P14, P19 have been folded against the cigarette bundle, the drum FD is rotated through a further stepwise movement to bring the partly formed packet to rest at position G (FIGS. 1 and 18). Whilst moving from position F to position G the arcuate plate 357 holds the panels P14, P19 in the position to which they are moved by the folders 345, 346. FIG. 29 shows a perspective view of a partly formed packet as it is when at position G.

Whilst the partly formed packet is held stationary at position G the gluing device 359 and plate 360 are moved towards each other to engage opposite faces of each of the panels P4, P5, P10, P11. The gluing device 359 is provided with nozzles through which hot-melt adhesive is caused to flow on to the panels P2, P5, P10, P13 as described in detail in the above mentioned application, the plate 360 forming an anvil against which the panels are pushed as the adhesive is applied.

After one more stepwise movement of the drum FD the partly formed packet is brought to rest at position H, the arcuate plate 358 holding the panels P14, P19 in place during this movement. At position H the partly formed packet is in radial alignment with and positioned between the pusher 232 and the entrance to the passage 388 in the stacking unit SU.

The pusher 323 is reciprocated radially of the drum FD, to push a partly formed packet from each procket 313 in turn into the unit SU, by the crank disc 333 driven by shaft 334, a cyclic speed variation being imposed on the reciprocating movement, due to the bush 338, carried on crank disc 340, sliding towards and away from the rotational axis of the shaft 334, this sliding movement being in turn, due to the fact that the shafts 334 and 341 are not in axial alignment. Thus, although the shaft 341 is driven continuously at a constant speed, the shaft 334 is driven continuously at a cyclically varying speed.

When the partly formed packet has been brought to rest at position H the pusher is already moving radially outwards of the drum FD at a decreasing speed. Just before the shaft 334 reaches its minimum speed (which occurs when the bush 338 is at the end of the shaft 337 remote from the block 336) it engages the partly formed packet and pushes it out of the pocket 313 into the passage 388 of the unit SU. During this movement the partly formed packet engages the control flaps 389, 390 which start to move in unison with the packet under the control of the linkages 393, 394. As the packet is moved further into the passage 388 the panels P2, P7 and P8, P13 are engaged respectively by the resiliently mounted front plates 377, 382 and folded into contact with, and stuck to, panels P4, P5 and P10, P11, to complete the formation of the packet. FIG. 30 shows a perspective view of a completed packet. The flaps 389, 390 are provided to prevent the panel P19 from bowing as the panels P2, P7, P8, P13 are folded, as explained above. As the packet is moved between the plates 377, 382 the flaps 389, 390 are progressively withdrawn from the passage 388, whilst being kept in contact with the panel P19. The packet is moved along the passage 388 by the pusher 323 until the latter reaches the limit of its movement outwards of the drum FD, at which time the speed of the shaft 334 is increasing, and reaches its maximum during part of the pusher's return stroke (i.e. while it is moving back out of the passage 388, and through the aperture 318 in the pocket 313) to allow the drum FD to be rotated through a further step to bring the next partly formed packet to rest at position H. The above sequence of operations is repeated after each stepwise movement of the drum FD so that a column of packets is formed in the passage 388; as each packet is pushed into the passage 388 by the pusher 323, the whole column of packets is moved to the left (as viewed in FIG. 21) along the passage by a distance equal to the width (the dimension measured in the direction the packets are moved through the passage 388) of a packet, i.e. each packet advances one place.

As the packets move intermittently along the passage 388 they pass between the heater blocks 372, 379, the heat causing the hot-melt adhesive, previously applied by the device 359 at position G, to soften. Then whilst the packets are passing along the part of the passage 388 to the left (as viewed in FIG. 21) of the heater blocks 372, 379, the pressure plates **374*a*, 380 and the side walls 383, 384** combine to act on the packet and ensure that the packet has the required external dimensions, and also that all the corners are right angles.

The heater block 372 is held against the packets passing through the passage 388 by the piston rod 370, which is urged to the right (as viewed in FIG. 22) by air acting on a piston inside the cylinder 371, the piston rod pushing the plate 363 down via the member 368 and stud 369. If for some reason the machine stops the heater block 372 is moved away from the packets by the spring 364, this being made possible by air acting on the piston of the cylinder 371 to move the piston rod 370 to the left (as viewed in FIG. 22). It will be understood that the heater block 379 is moved away from the packets at the same time as, and in a similar manner to, that of the heater block 372.

As each packet in turn is pushed out of the left hand end (as viewed in FIG. 21) of the passage 388 (by reason of a partly formed packet being pushed into the passage by the pusher 323) it enters the top of the chute 402, and is moved down the latter by the plunger 403 into the packet orientation unit PO.

PACKET ORIENTATION UNIT

The unit PO is shown in FIG. 31 and consists of a spider 408 fixed to a shaft 409 which is driven intermittently in an anti-clockwise direction (as viewed in FIG. 31) in 120° steps. The spider 408 is provided with three equally spaced radial arms 410, each of which has a stub shaft 411 journalled in it at its outer end, each stub shaft 411 protruding from both sides of the associated arm 410. Fixed to each stub shaft 411 on one side of the arms 410 is a holder 412, each of which is provided with a back plate 413, two side walls 414, 415, and two front plates 416, 417, fixed on the side walls 414, 415 respectively, so that they extend towards each other, at right angles to the side walls, and are of such a size that a space, in the form of an open ended slot 418, is left between them.

Fixed to each stub shaft, on the other side of the arms 410 is a planet gear 419, the latter meshing with a sun gear 420. The arrangement is such that the sun gear 420 may be either non-rotatably attached to a fixed part of the machine (not shown) or, by repositioning a few fixed bolts (not shown), attached to a part of the unit PO which rotates with the shaft 409, so that the sun gear 420 rotates in unison with the shaft 409, and therefore also the spider 408.

Journalled in a fixed part of the machine (not shown) is a shaft 421 on which is fixed one end of an arm 422, the other end of the arm being pivotally connected to one end of a link 424. Freely pivoted, at one end, on the shaft 421 is a link 423, the other end of each of the links 423, 424 being pivotally connected at 425, 426 respectively to an operating lever 427, the connection 425 being at one end of the lever 427. Also pivotally connected, at 428, to the lever 427 is one end of a short arm 429, the other end of which is fixed to a stub shaft 430 journalled in a fixed part of the machine (not shown). Fixed to the other end of the lever 427 is a pusher 431 which is formed by a rod which extends from the lever 427 at right angles thereto into the plane of the drawing (i.e. away from the viewer). The shaft 421 is oscillated by a bell-crank lever fixed to the shaft, each of the two arms of the bell-crank lever carrying a roller each of which engages one of a pair of cams fixed to a continuously rotated shaft, the cams combining to give the required motion to the shaft. None of the various parts recited above for causing oscillation of the shaft 421 are shown in the drawings. The arrangement is such that as the arm 422 oscillates with the shaft 421, the various arms and links cause the pusher 431 to be moved, in a substantially straight line, from the full line position to the chain-dot position, shown in FIG. 31, and back again.

In operation, with the parts in the position shown in FIG. 31, the plunger 403 (FIG. 22) pushes a completed packet down the chute 402 and into one of the holders 412 at position J (FIGS. 1 and 31), the internal dimensions of the chute 402 being such that the packet is firmly held.

On being pushed into the holder 412 the packet is so orientated that panels P14, P19 engage the side wall 415 and the panels P8, P13 engage the back plate 413. In the present instance it will be assumed that the sun gear 420 is non-rotatably attached to a fixed part of the machine. After the plunger has been moved out of contact with the packet, the spider 408 is rotated through one stepwise movement to bring the packet to rest at position K. While moving from position J to position K the holder 412 containing the packet is rotated about the axis of the stub shaft 411 by the planet gear 419 rolling round the stationary sun gear 420. After the packet has been brought to rest at position K it is ejected from the holder 412 by the pusher 431 being moved from the full line position, through the slot 418, to the chain-dot position in FIG. 31.

The spider 408 is then rotated through a further stepwise movement, the pusher 431 being returned to the full line position, during this movement, by passing between the holder 412 from which a packet has just been ejected at position K, and the next holder 412 into which a packet has just been pushed at position J. Under normal operating conditions, after each stepwise movement of the spider 408, a packet is pushed into a holder 412 at position J and, at the same time, a packet is ejected from a holder 412 at position K.

With the sequence of operations described above, with reference to FIG. 31, the packet is ejected from the holder 412 by the pusher 431 engaging the panels P2, P7, as shown in FIG. 32A.

If, as stated above, the sun gear 420 is attached to a part of the unit PO which rotates with the shaft 409, the sun gear will rotate at the same speed as the spider 408, and consequently there will be no relative motion between the sun gear 420 and the planet gear 419. Thus the holders will not rotate about the axis of their respective shaft 411. In this case the packets are ejected from the holders 412 by the pusher engaging the panels P13, P8, as shown in FIG. 32B.

As well as being used for conveying packets from position J to position K and delivering them in the desired orientation, the unit PO may be used as means from which faulty packets, or sample packets, are ejected. The manner of ejection is the same in each case, but with faulty packets the ejection operation is started automatically and with sample packets the ejection operation is started by the machine operator.

If a packet is to be ejected from the unit PO, other than normal operation when it is ejected at position K, the pusher 431 is prevented from operating as described above, by any convenient device (not shown), so that the packet to be ejected is carried in one of the holders 412 beyond the position K and brought to rest at the rejection position RP (FIG. 31). Whilst in this position the packet may be ejected by a pusher (not shown) which, for example, may be similar in construction and operation to the pusher 431. Alternatively the packet to be ejected may be carried beyond the position RP, so that it is brought to rest at position J. In this case it will be ejected from the holder 412 by the next packet as the latter is pushed into the holder 412 by the plunger 403.

ALTERNATIVE BLANK CONVEYOR

An alternative form of blank transfer conveyor for conveying blanks from the blank feeding device BF to the position A, adjacent the drum FD, will now be described with reference to FIG. 33, and where applicable the same reference numerals as used in FIGS. 2 to 4 and 18 will be used for like parts.

The apparatus for feeding blanks to the conveyor shown in FIG. 33 is similar in construction and operation to that described previously with reference to FIGS. 2, 3 and 4 so will not be described in detail again. The leading blank is removed from the hopper BH by the suction pads 51 and moved to the left (as viewed in FIG. 33) until it engages the plate 22, at which time suction is removed from the pads 51. The blank is then pushed upwardly until it is gripped between adjacent runs of two endless belts 440, 441.

Positioned adjacent the plate 22 and near the upper edge thereof is an adhesive applicator nozzle 442 which operates in the same way as nozzles 128, 129 described previously, the plate 22 acting as the means to operate the nozzle. The nozzle 442 is movable towards and away from the plate 22 and is so positioned that as the blank is being lifted towards the belts 440, 441, a line of adhesive is applied to the panel P14 (FIG. 2).

The belt 440 extends round rollers 443, 444, 445 and the belt 441 extends round rollers 446, 447, 448 and 449, the latter being fixed to a shaft **449*a*. Both the belts 440, 441** are driven continuously by any convenient means (not shown).

As the blank is being fed upwardly by the belts 440, 441 the panel P1 is folded over (i.e. through 180°), by a plough folder 450 positioned adjacent the bands 440, 441 between the rollers 443, 446 and the roller 447, into contact with the panel P14 and stuck thereto by the adhesive previously applied by the applicator nozzle 442.

Mounted on the same shaft as the roller 445 and rotatable therewith is a roller 451 having a portion 452 of larger radius shaped as shown in FIG. 33. The peripheral surface of the portion 452 is adapted to print or emboss part of the blank with some form of identification marks of the like, as the blank passes between the portion 452 and the roller 447. As with the device 134 (FIG. 6A) the portion 452 is arranged so that the identification marks it applies are printed or embossed on the panel P18 of the blank (FIG. 2).

After leaving the grip of the belts 440, 441 the blank is fed to the right (as viewed in FIG. 33) by being gripped between adjacent runs of the belt 441 and an upper conveyor 453, the latter extending between pulleys 454, 455 fixed to shafts 454*a*, 455*a* respectively. The blank is only fed for a short distance by the belt 441 and conveyor 453 (i.e. from the pulley to the roller 449) whereafter the blank is gripped and fed between adjacent runs of the upper conveyor 453 and a lower conveyor 456 which extends between a pulley fixed to the shaft 449*a* and a pulley 457, fixed on a shaft 457*a* positioned below the shaft 455*a*. Extending respectively below further pulleys fixed to the shafts 455*a*, 457*a* and pulleys 458, 459 are further upper and lower conveyors 460, 461. It will be understood that each of the conveyors 453, 456, 460 and 461 comprises a number of relatively narrow belts which are spaced apart laterally so that the blanks are engaged at spaced positions across their width.

As the blank is being fed by the conveyors 453, 456 it passes a detector device generally indicated at 462, comprising two holders 463, 464 containing elements (not shown) of the device, which is constructed and operates in a similar manner to the detector device 150 described previously with reference to FIG. 6A. Thus at predetermined times the circuitry associated with the holders 463, 464 is switched on so that the disposition of the blank may be determined.

On continued feeding by the conveyors 453, 456 the blank passes a gumming unit 465 having a number of adhesive applicator nozzles 466 which are arranged to apply adhesive to the panels P5, P6, P9 and P10. If required, adhesive may also be applied to the panels P15 and P18. The nozzles 128 described previously with reference to FIG. 6C. To enable the nozzles to be operated a backing plate 467 is provided adjacent to the appropriate area of the conveyor 453. The conveyors 453, 456, 460, 461 are preferably driven continuously by any convenient means (not shown), but alternatively they may, if desired, be driven intermittently, so that the blank is stopped opposite the gumming unit 465 in order that the required adhesive may be applied.

After passing the gumming unit 465 the blank is fed further to the right (as viewed in FIG. 33) by the conveyors 453, 456 and then by the conveyors 460, 461 until, after passing out of the grip of the conveyors 460, 461 it comes to rest with its leading edge a short distance away from the plate 270. The blank is then pushed forward by any convenient device (not shown) so that its leading edge abuts against the plate 270 in which position the blank is at position A.

The blank is then transferred into a pocket 313 of the drum FD by apparatus which is constructed and operates in the same manner as the apparatus previously described with reference to FIGS. 18 and 20, and will not be described again.

To ensure that the blank is correctly aligned before being transferred into a pocket 313 of the drum FD a further detector device (not shown), similar in construction and operation to the detector device 150 (FIG. 6A) may be positioned adjacent the position A.

We claim:

1. Apparatus for packing an article in a packet including:

a. a rotatable member having a plurality of pockets, b. means for intermittently rotating said rotatable member so that each pocket in turn is moved in steps along a path to an insertion position, to a loading position and to an ejection position;

c. supply means to feed packet blanks in succession to said insertion position adjacent said rotatable member;

d. inserting means for moving each successive blank at said insertion position into one of said pockets while said rotatable member is stationary and for performing folding operations on each blank to start its formation into a packet as it is moved into the pocket;

e. loading means for delivering an article into each partially formed packet at said loading position;

f. means for performing further folding operations on each partially formed packet while moving along said path between said loading position and said ejection position;

g. folding means for completing formation of the packets;

h. ejector means for pushing the partially formed packets out of said pockets at said ejection position into said folding means;

i. said inserting means including a cyclically movable support for conveying blanks one at a time past stationary folder members so that successive edge portions of the blank protruding from the support are folded by engagement with successive ones of the stationary members, said support comprising a platform having at least two relatively-movable portions, and drive means for moving each of said portions in timed relation to the movement of the other portion of portions so that initially both or all portions of the support are aligned to receive a flat blank and move said blank past a first stationary folder member disposed to engage and fold an edge portion of the blank projecting from one portion of the platform, whereafter said one portion of the platform stops while motion of at least one other portion of the platform continues past another stationary folder member disposed to engage and fold another edge portion of the blank projecting from said other portion of the platform; and j. said folding means for completing formation of the packets includes a tubular member having walls defining an internal passage of such cross-section to permit a packet to pass through it with one face leading while engagement of flaps on said packet with said walls of said passage causes said flaps to be folded against side faces of the packet, and a counter-member movable through said passage in synchronism with movement of the ejector means and in advance of said ejector means by a distance equal to the thickness of the packet as measured perpendicular to said one face, said counter-member having a surface facing said ejector means for engagement with said one face of the packet to oppose distortion thereof during folding of said flap.

2. Apparatus as claimed in claim 1, in which said tubular member comprises four substantially planar walls arranged in parallel pairs to define a rectangular internal passage, each of said walls being so mounted as to have limited freedom of movement normal to its plane and resilient means associated with each said wall so as to bias the latter inwardly to minimize the cross-section of said passage when no packet is therein.

3. Apparatus as claimed in claim 2, including four further resiliently-mounted walls defining a continuation of said internal passage, and heating means associated with said continuation of said passage.

4. Apparatus as claimed in claim 16 in which the platform has three portions, comprising a central portion positioned between two outer portions, said drive means being arranged to move said portions cyclically so that in an initial part of the cycle all three portions are moved in synchronism and during a later part of the cycle the movement of the central portion is continued while the outer portions are stationary, a plurality of said first stationary folder members being arranged to engage portions of the blank projecting from said outer portions of the platform during said initial part of the cycle and a plurality of said other stationary folder members being arranged to engage portions of the blank projecting from the central part of the platform during said later part of the cycle.

5. Apparatus as claimed in claim 4 in which said first folder members comprise folders and tuckers.

6. Apparatus for packing an article in a packet comprising:

a. a rotatable member having a plurality of pockets adapted to receive packet blanks;

b. drive means for indexing said rotatable member in steps corresponding to the spacing between the pockets so that each pocket in turn is indexed along a path to an insertion position, to a loading position and to an ejection position in succession;

c. supply means for feeding said blanks successively to said insertion position adjacent said rotatable member;

d. inserting means for moving each successive blank at said insertion position into one of said pockets while said rotatable member is stationary and for performing folding operations on each blank to form it partially into a packet as it is moved into the pocket;

e. loading means for delivering an article into each partially formed packet at said loading position;

f. means for performing further folding operations on each partially formed packet while moving along said path between said loading position and said ejection position;

g. folding means for completing formation of the packets; and h. ejector means for pushing the partially formed packets out of said pockets at said ejection position into said folding means for completing the formation of the packets;

i. said inserting means including: first and second stationary folder members to initiate folding of each blank, a platform for supporting each blank and movable past said first and second stationary folder members, said platform having at least two parts movable relative to one another, second drive means operative to move said parts in aligned relationship, after receipt of each flat blank on the platform, through a predetermined distance past said first stationary member positioned to engage and fold an edge portion of each blank projecting from one part of the platform, said second drive means after effecting movement over said distance being operable to continue moving at least another part of the platform past said second stationary member, which is disposed to engage and fold another edge portion of each blank projecting from said other part, while leaving said one part stationary.

7. Apparatus as claimed in claim 6 in which said loading means comprises endless conveyor means adjacent said rotatable member and provided with a plurality of article-receiving recesses; means for feeding two articles at a time to a further insertion position adjacent said conveyor means; further inserting means for simultaneously moving two articles at a time from said further position into two adjacent recesses of the conveyor means; further drive means for indexing the conveyor means in steps so that each recess in turn is brought to rest at said loading position; and transfer means at said loading position operable to transfer each article in turn from a recess into a partially formed packet in a stationary pocket at said loading position so that said further inserting means is only separated once for each two operations of the transfer means.

8. Apparatus as claimed in claim 7 in which said conveyor means is a rotatable drum, and in which said further inserting means comprises: two platforms symetrically disposed adjacent said drum so that when the drum is stationary with a recess located at the loading position two other recesses are positioned to receive articles from said platforms; and means for moving said platforms to insert articles carried thereon into said two other recesses after every second indexing movement of the rotatable drum.

9. Apparatus for packing an article in a packet comprising:

a. a rotatable member having a plurality of pockets adapted to receive packet blanks;

b. drive means for indexing said rotatable member in steps corresponding to the spacing between the pockets so that each pocket in turn is indexed along a path to an insertion position, to a loading position and to an ejection position in succession;

c. supply means for feeding said blanks successively to said insertion position adjacent said rotatable member;

d. inserting means for moving each successive blank at said insertion position into one of said pockets while said rotatable member is stationary and for performing folding operations on each blank to form it partially into a packet as it is moved into the pocket;

e. loading means for delivering an article into each partially formed packet at said loading position;

f. means for performing further folding operations on each partially formed packet while moving along said path between said loading position and said ejection position;

g. folding means for completing formation of the packets; and h. reciprocally movable ejector means for pushing the partially formed packets out of said pockets at said ejection position into said folding means for completing the formation of the packets;

i. said folding means for completing formation of the packets including: a tubular member having walls which define an internal passage of such cross-section to permit a packet to pass through it with one face leading while engagement of flaps on said packet with said walls of said passage causes said flaps to be folded against side faces of the packet; and a counter-member movable in an arcuate path through said passage in synchronism with movement of said ejector means, and in advance of said ejector means by a distance equal to the thickness of the packet as measured perpendicular to said one face; said counter-member having a surface facing said ejector means for engagement with said one face of the packet to oppose distortion thereof during folding of said flaps.

10. In apparatus for packing an article in a packet comprising:

a. means movable along a path to an insertion position and defining a plurality of pockets;

b. supply means to feed flat packet blanks in succession to said insertion position; and c. inserting means for moving each successive blank at said insertion position into one of said pockets and for performing folding operations on each blank to form it partially into a packet as it is moved into the pocket, d. said inserting means including: first and second stationary folder members to initiate folding of each blank, a platform for supporting each blank and movable past said first and second stationary folder members, said platform having at least two parts movable relative to one another, drive means operative to move said parts in aligned relationship, after receipt of each flat blank on the platform, through a predetermined distance past said first stationary member positioned to engage and fold an edge portion of each blank projecting from one part of the platform, said drive means after effecting movement over said distance being operable to continue moving at least another part of the platform past said second stationary member, which is disposed to engage and fold another edge portion of each blank projecting from said other part, while leaving said one part stationary.

11. Apparatus as claimed in claim 10 wherein said movable means is adapted to move each pocket successively from said insertion position to a loading position, said apparatus further comprising loading means for delivering an article into each partially formed packet at said loading position, said loading means comprising endless conveyor means adjacent said path and provided with a plurality of article-receiving recesses; means for feeding two articles at a time to a further insertion position adjacent said conveyor means; further inserting means for simultaneously moving two articles at a time from said further position into two adjacent recesses of the conveyor means; further drive means for indexing the conveyor means in steps so that each recess in turn is brought to rest at said loading position; and transfer means at said loading position operable to transfer each article in trun from a recess into a partially formed packet in a stationary pocket at said loading position so that said further inserting means is only operated once for each two operations of the transfer means.

12. Apparatus as claimed in claim 11 in which said conveyor means is a rotatable drum, and in which said further inserting means comprises: two platforms symetrically disposed adjacent said drum so that when the drum is stationary with a recess located at the loading position two other recesses are positioned to receive articles from said platforms; and means for moving said platforms to insert articles carried thereon into said two other recesses after every second indexing movement of the rotatable drum.

13. Apparatus for packing an article in a packet comprising folding means for completing formation of partially formed packets produced from blanks and containing an article therein, reciprocally movable ejector means for pushing said partially formed packets into said folding means, said folding means comprising a tubular member having walls which define an internal passage of such cross-section to permit a packet to pass through it with one face leading while engagement of flaps on said packet with said walls of said passage causes said flaps to be folded against side faces of the packet; and a counter-member movable in an arcuate path through said passage in synchronism with movement of said ejector means and in advance of said ejector means by a distance equal to the thickness of the packet as measured perpendicular to said one face; said counter-member having a surface facing said ejector means for engagement with said one face of the packet to oppose distortion thereof during folding of said flaps.

14. Apparatus as claimed in claim 9 in which the counter-member comprises a pair of members pivoted at opposite sides of the passage, each said surface which faces said ejector means being planar, and linkage means for moving the pair of members along said arcuate path with said surfaces co-planar and for progressively moving the pair of members laterally out of the passage to allow said ejector means to push the packet past the pair of members.

15. Apparatus as claimed in claim 14 further comprising a stacking section of such a length as to accommodate a plurality of abutting packets with their side faces in alignment, said passage extending into said stacking section, and heating means in the stacking section for securing the flaps to the side faces of the packets, said ejector means being adapted with each reciprocating movement to move a packet into abutment with the last one of said plurality of packets and further move said packet with said plurality of packets through a distance equal to the thickness of the packet.

16. Apparatus as claimed in claim 13 in which the counter-member comprises a pair of members pivoted at opposite sides of the passage, each said surface which faces said ejector means being planar, and linkage means for moving the pair of members along said arcuate path with said surfaces co-planar and for progressively moving the pair of members laterally out of the passage to allow said ejector means to push the packet past the pair of members.

17. Apparatus as claimed in claim 16 further comprising a stacking section of such a length as to accommodate a plurality of abutting packets with their side faces in alignment, said passage extending into said stacking section, and heating means in the stacking section for securing the flaps to the side faces of the packets, said ejector means being adapted with each reciprocating movement to move a packet into abutment with the last one of said plurality of packets and further move said packet with said plurality of packets through a distance equal to the thickness of the packet.

* * * * *